US009739566B2

(12) United States Patent
Huang

(10) Patent No.: US 9,739,566 B2
(45) Date of Patent: Aug. 22, 2017

(54) RECOIL BUFFER SYSTEM

(71) Applicant: George Huang, Henderson, NV (US)

(72) Inventor: George Huang, Henderson, NV (US)

( * ) Notice: Subject to any disclaimer, the term of this patent is extended or adjusted under 35 U.S.C. 154(b) by 0 days.

(21) Appl. No.: 15/180,895

(22) Filed: Jun. 13, 2016

(65) Prior Publication Data

US 2017/0067716 A1 Mar. 9, 2017

Related U.S. Application Data

(63) Continuation-in-part of application No. 14/922,152, filed on Oct. 24, 2015, now Pat. No. 9,395,148, which is a continuation-in-part of application No. 14/738,607, filed on Jun. 12, 2015, now Pat. No. 9,341,437.

(51) Int. Cl.
*F41C 23/06* (2006.01)

(52) U.S. Cl.
CPC ..... *F41C 23/06* (2013.01)

(58) Field of Classification Search
USPC ..... 42/1.06, 69.02, 71.01, 74; 89/177, 198, 89/199
See application file for complete search history.

(56) References Cited

U.S. PATENT DOCUMENTS

| | | | | |
|---|---|---|---|---|
| 6,829,974 | B1 | 12/2004 | Gwinn, Jr. | |
| 7,478,495 | B1 | 1/2009 | Alzamora et al. | |
| 8,943,947 | B2 | 2/2015 | Gomez | |
| 9,341,437 | B1 * | 5/2016 | Huang | F41A 3/84 |
| 9,395,148 | B1 * | 7/2016 | Huang | F41C 23/06 |
| 2006/0236853 | A1 | 10/2006 | Boersching et al. | |
| 2010/0050492 | A1 | 3/2010 | Faifer | |
| 2010/0251588 | A1 | 10/2010 | Kincel | |
| 2013/0192114 | A1 | 8/2013 | Christenson | |
| 2013/0319217 | A1 | 12/2013 | Gangl et al. | |
| 2014/0059909 | A1 | 3/2014 | Caudle | |

* cited by examiner

*Primary Examiner* — J. Woodrow Eldred
(74) *Attorney, Agent, or Firm* — Shaddock Law Group, PC

(57) ABSTRACT

A recoil buffer system having a buffer element with a buffer element body portion, a buffer element knob, and a buffer element cavity; a collar; a sleeve, wherein a sleeve recess is formed so as to accept at least a portion of the buffer element body portion therein; a buffer element recoil spring, wherein the buffer element recoil spring is positioned about at least a portion of the elongate buffer element body portion, between the collar and the sleeve; and a bumper, wherein a bumper extension portion extends from a first end of the bumper to a bumper shoulder, wherein the bumper extension portion is such that at least a portion of the bumper extension portion can be fitted at least partially within the sleeve aperture.

20 Claims, 21 Drawing Sheets

RECOIL BUFFER SYSTEM

CROSS-REFERENCE TO RELATED APPLICATIONS

This application claims the benefit of U.S. patent application Ser. No. 14/922,152, filed Oct. 24, 2015, and U.S. patent application Ser. No. 14/738,607, filed Jun. 12, 2015, now U.S. Pat. No. 9,341,437, issued May 17, 2016, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to a recoil buffer system for a firearm.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a variable position buttstock 2 that is slidable and lockable at various positions along a buffer tube 5. A typical variable position buttstock 2 can be locked into a collapsed position, as illustrated in FIG. 1, or locked into a fully extended position, as illustrated in FIG. 2.

As further illustrated in FIGS. 3 and 4, the typical buffer tube 2 includes a capped cylindrical portion having a threaded portion 8 for installation into a buffer tube receiving aperture 11 of a lower receiver 10. Typically, an endplate 6 and a lock ring 4 are utilized to complete installation of the buffer tube 5 on the receiver. A key protrusion 7 extends from the cylindrical portion 9, typically at the 6 o'clock position. An interior portion of the key protrusion includes a plurality of spaced apart recesses or apertures that interact with a retractable bolt to lock the buttstock 2 in a desired position relative to the buffer tube 5.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier 13 and the bolt and drives the bolt carrier 13 rearward.

The buffer 3, which is pushing on the rear of the bolt carrier group, is forced rearward by the bolt carrier group, compressing the recoil spring 1. During this rearward movement, a cam track in the upper portion of the bolt carrier 13 acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer 3 contacts the bottom wall at the rear of the buffer tube 5), the compressed recoil spring 1 expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier 13 enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, the typical buffer tube 5 must be relatively lengthy to accommodate the recoil spring 1, the buffer 3, and a rear portion of the bolt carrier 13 (during the firing cycle). This results in a buffer tube 5 that is relatively lengthy, heavy, and cumbersome.

Additionally, attempts to produce compact buffer tube assemblies rely on a design that incorporates the bolt carrier and the buffer into a combined assembly that is either fixed, pinned, or connected by an adapter. This single unit design does not allow the user to "shotgun" the upper and requires that the user incorporate a proprietary bolt carrier.

Furthermore, known buffers do not take advantage of the weight of the buffer element body as part of the dead blow reciprocating mass. Thus, mass of the known buffer is wasted.

The disadvantages and shortcomings of the prior art are overcome by the features and elements of the recoil buffer system of the present disclosure. The advantages of the present disclosure are preferably attained by providing, in an exemplary, nonlimiting embodiment, a recoil buffer system, comprising a buffer tube, wherein the buffer tube comprises an elongate portion of material extending, along a longitudinal axis, from a first end to a second end and having an internal buffer tube cavity defined by an open end, one or more side walls, and a bottom wall; a buffer tube recoil spring, wherein the buffer tube recoil spring extends from a first end to a second end; a buffer element, wherein the buffer element comprises an elongate buffer element body portion extending from a buffer element knob, wherein the buffer element comprises a buffer element cavity defined by an open end, one or more side walls, and a bottom wall; a collar, wherein a collar aperture is formed through the collar, along a longitudinal axis of the collar, wherein a substantially cylindrical collar recess extends from a first end of the collar and is defined by one or more side walls and a collar recess shoulder; a sleeve, wherein a sleeve aperture is formed through the sleeve, along a longitudinal axis of the sleeve, wherein the sleeve aperture is formed so as to accept at least a portion of the bumper therein, wherein a substantially cylindrical sleeve recess extends from a first end of the sleeve and is defined by one or more side walls and a sleeve spring recess shoulder, wherein the sleeve recess is formed so as to accept at least a portion of the buffer element body portion therein; a buffer element recoil spring, wherein the buffer element recoil spring is positioned about at least a portion of the elongate buffer element body portion, between the collar and the sleeve; and a bumper, wherein a bumper extension portion extends from a first end of the bumper to a bumper shoulder, wherein the bumper extension portion is such that at least a portion of the bumper extension portion can be fitted at least partially within the sleeve aperture.

In still other exemplary, nonlimiting embodiments, a recoil buffer system is provided that comprises a buffer element, wherein the buffer element extends from an elongate buffer element body portion to a buffer element knob, wherein the buffer element comprises a buffer element cavity defined by an open end, one or more side walls, and a bottom wall; a collar, wherein a collar aperture is formed through the collar, along a longitudinal axis of the collar, wherein a substantially cylindrical collar recess extends from a first end of the collar and is defined by one or more side walls and a collar recess shoulder; a sleeve, wherein a sleeve aperture is formed through the sleeve, along a longitudinal axis of the sleeve, wherein a substantially cylindrical sleeve recess extends from a first end of the sleeve and is defined by one or more side walls and a sleeve spring recess shoulder, wherein the sleeve recess is formed so as to accept at least a portion of the buffer element body portion therein; a buffer element recoil spring, wherein the buffer element recoil spring is positioned about at least a portion of the elongate buffer element body portion, between the collar and the sleeve; and a bumper, wherein a bumper extension portion extends from a first end of the bumper to a bumper shoulder, wherein the bumper extension portion is such that at least a portion of the bumper extension portion can be fitted at least partially within the sleeve aperture.

Accordingly, the presently disclosed systems, methods, and/or apparatuses provide a recoil buffer system that allows for the use of a shortened, more compact buffer tube.

The presently disclosed systems, methods, and/or apparatuses separately provide a recoil buffer system that utilizes at least a buffer tube recoil spring and a buffer element recoil spring.

The presently disclosed systems, methods, and/or apparatuses separately provide a recoil buffer system that provides recoil management with a buffer element requiring a shorter distance of travel.

The presently disclosed systems, methods, and/or apparatuses separately provide a recoil buffer system that can be utilized in conjunction with a standard bolt carrier.

The presently disclosed systems, methods, and/or apparatuses separately provide a recoil buffer system that allows the user to "shotgun" the upper receiver.

The presently disclosed systems, methods, and/or apparatuses separately provide a recoil buffer system that utilizes various components of the buffer assembly as part of a reciprocating mass.

The presently disclosed systems, methods, and/or apparatuses separately provide a recoil buffer system that provides and "dead below" effect.

The presently disclosed systems, methods, and/or apparatuses separately provide a recoil buffer system that allows a rifle operating system to be "tuned".

The presently disclosed systems, methods, and/or apparatuses separately provide a recoil buffer system that can be easily assembled and/or retrofitted by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
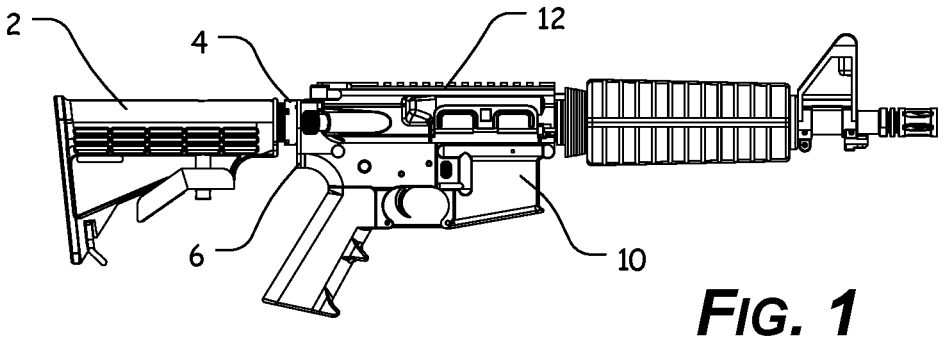
FIG. 1 PRIOR ART
FIG. 1 illustrates a side view of a standard, AR-15 or M4 style rifle having a collapsible buttstock, shown in a collapsed position relative to a standard buffer tube.
Figure 2:
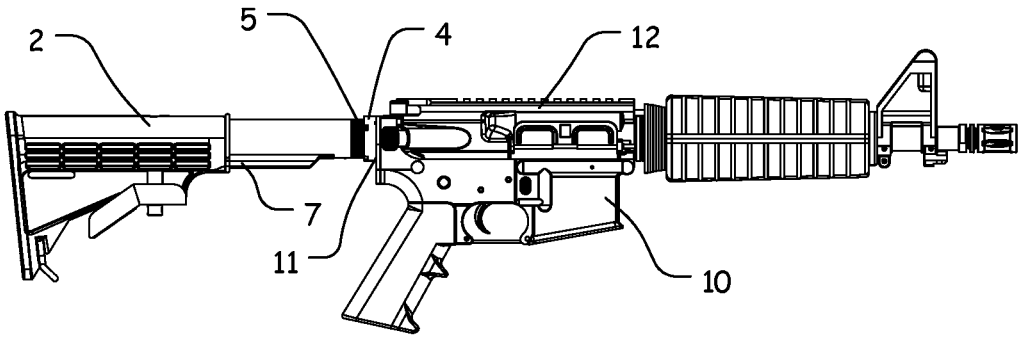
FIG. 2 PRIOR ART
FIG. 2 illustrates a side view of a standard, AR-15 or M4 style rifle having a collapsible buttstock, shown in an extended position relative to a standard buffer tube.
Figure 3:
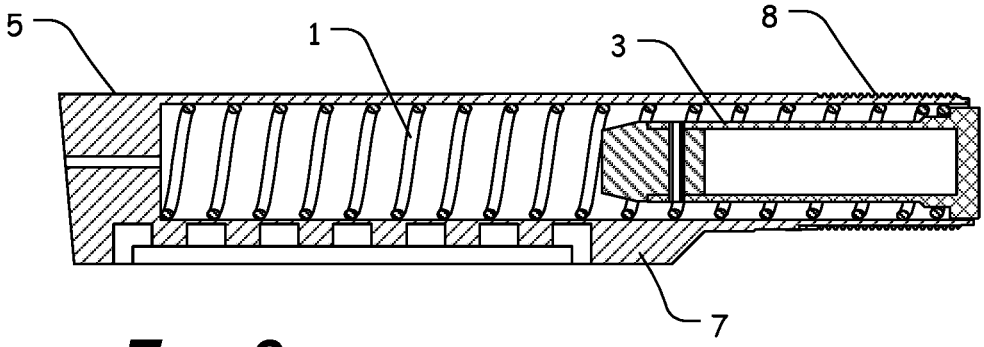
FIG. 3 PRIOR ART
FIG. 3 illustrates a side, cross-sectional view of a standard buffer fitted within a standard buffer tube.
Figure 4:
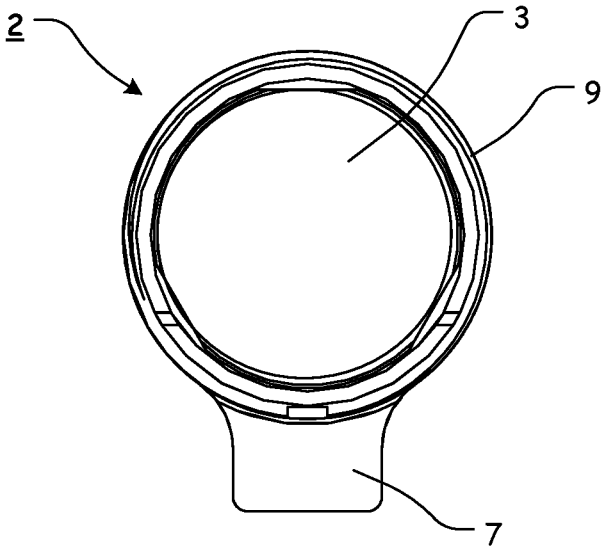
FIG. 4 PRIOR ART
FIG. 4 illustrates a front view of a standard buffer fitted within a standard buffer tube.
Figure 5:
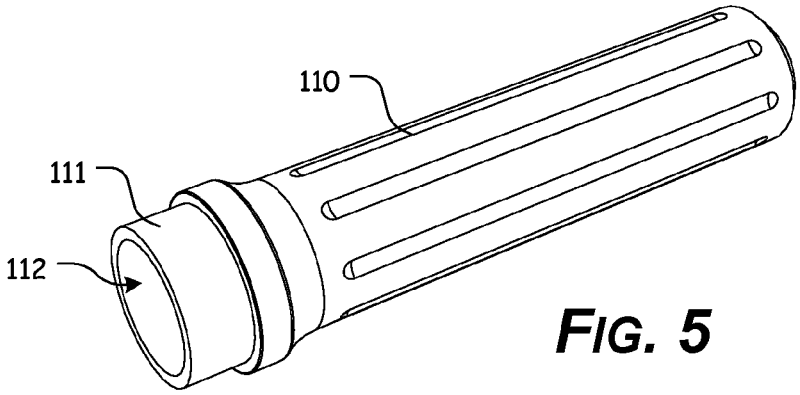
FIG. 5 illustrates an upper, front perspective view of an exemplary embodiment of a compact buffer tube, according to the presently disclosed systems, methods, and/or apparatuses.
Figure 6:
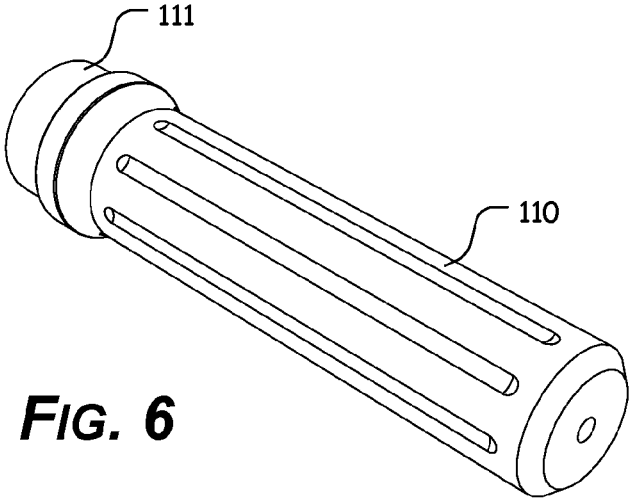
FIG. 6 illustrates an upper, rear perspective view of an exemplary embodiment of a compact buffer tube, according to the presently disclosed systems, methods, and/or apparatuses.
Figure 7:
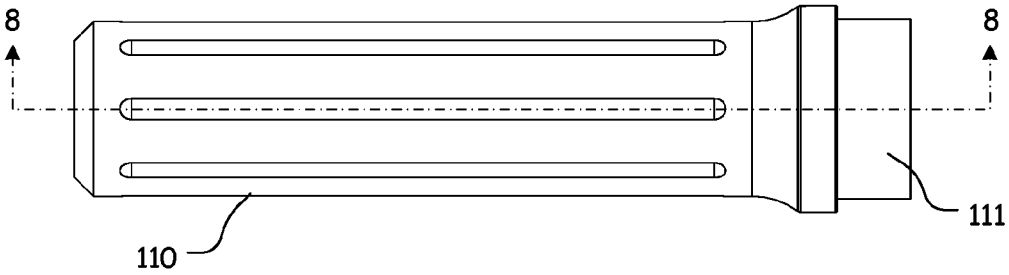
FIG. 7 illustrates a side view of an exemplary embodiment of a compact buffer tube, according to the presently disclosed systems, methods, and/or apparatuses.
Figure 8:
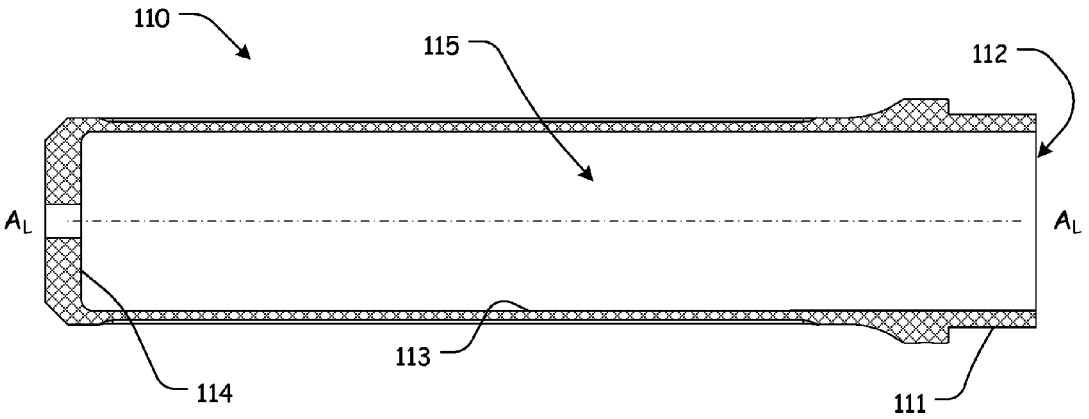
FIG. 8 illustrates a side cross-sectional view taken along line 8-8 of the compact buffer tube of FIG. 7, according to the presently disclosed systems, methods, and/or apparatuses.
Figure 9:
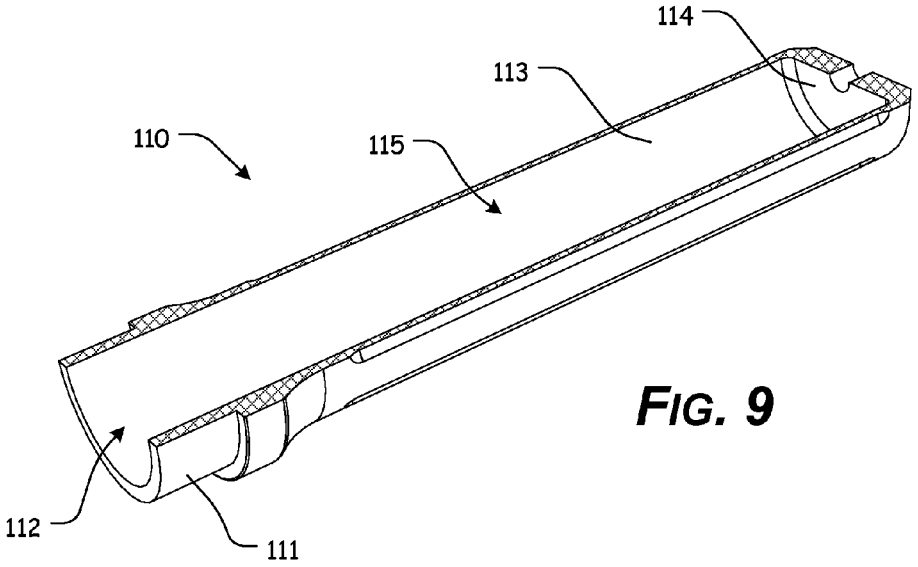
FIG. 9 illustrates a perspective cross-sectional view taken along line 8-8 of the compact buffer tube of FIG. 7, according to the presently disclosed systems, methods, and/or apparatuses.
Figure 10:
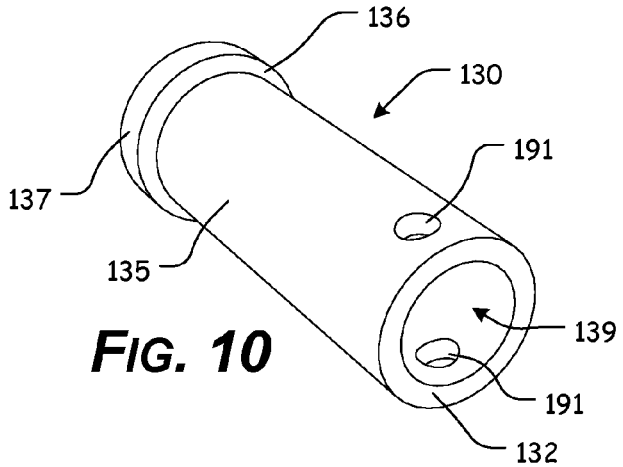
FIG. 10 illustrates an upper, rear perspective view of an exemplary embodiment of a buffer element, according to the presently disclosed systems, methods, and/or apparatuses.
Figure 11:
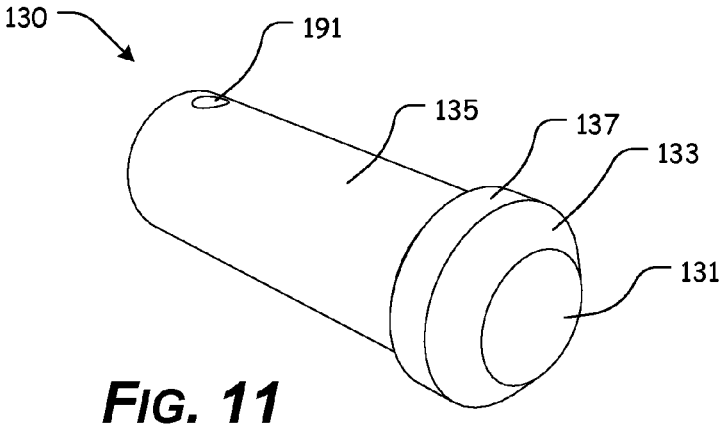
FIG. 11 illustrates an upper, front perspective view of an exemplary embodiment of a buffer element, according to the presently disclosed systems, methods, and/or apparatuses.
Figure 12:
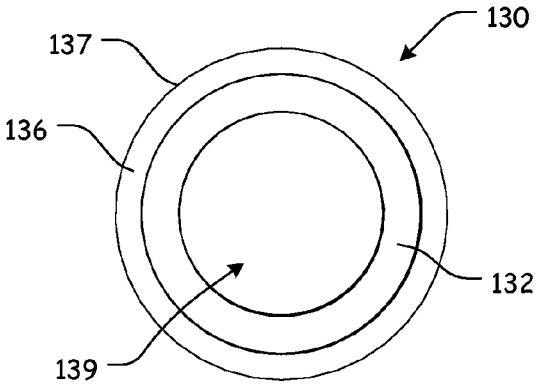
FIG. 12 illustrates a front view of an exemplary embodiment of a buffer element, according to the presently disclosed systems, methods, and/or apparatuses.
Figure 13:
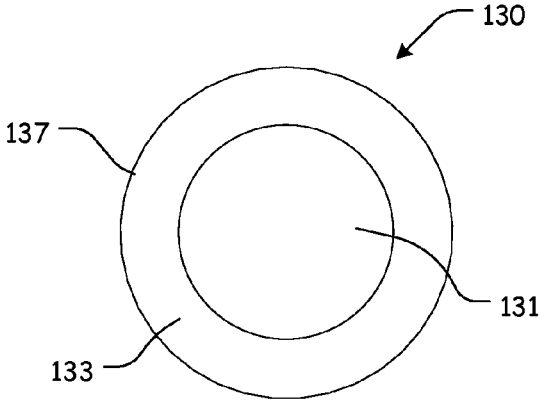
FIG. 13 illustrates a rear view of an exemplary embodiment of a buffer element, according to the presently disclosed systems, methods, and/or apparatuses.
Figure 14:
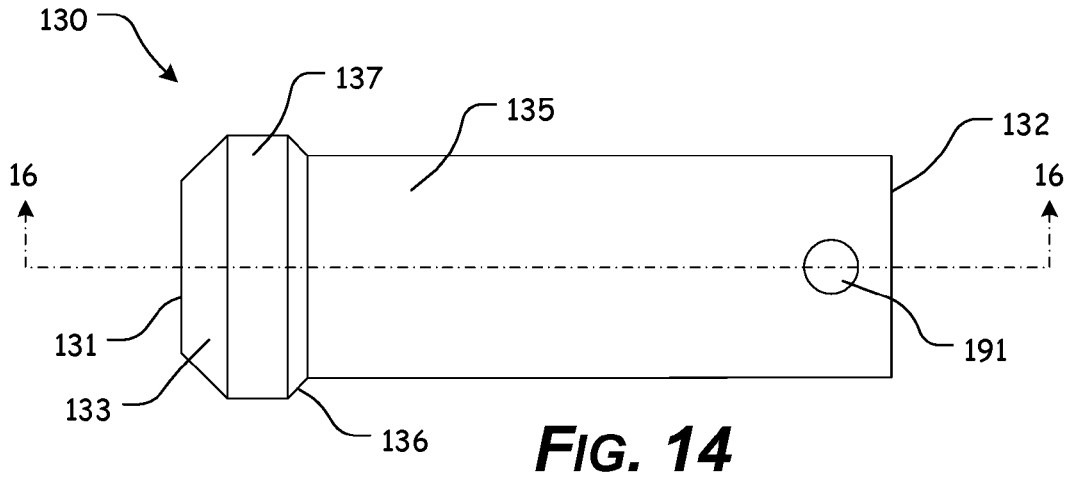
FIG. 14 illustrates a top view of an exemplary embodiment of a buffer element, according to the presently disclosed systems, methods, and/or apparatuses.
Figure 15:
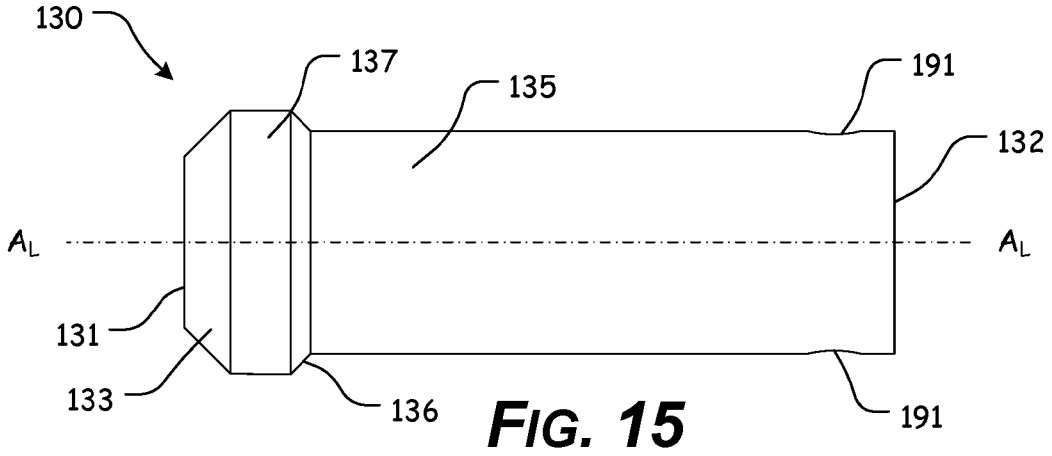
FIG. 15 illustrates a side view of an exemplary embodiment of a buffer element, according to the presently disclosed systems, methods, and/or apparatuses.
Figure 16:
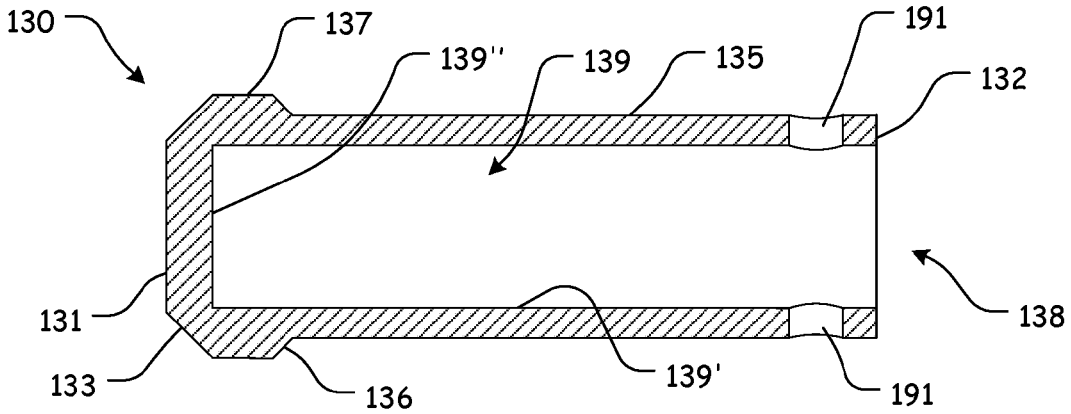
FIG. 16 illustrates a cross-sectional view taken along line 16-16 of the buffer element of FIG. 14, according to the presently disclosed systems, methods, and/or apparatuses.
Figure 17:
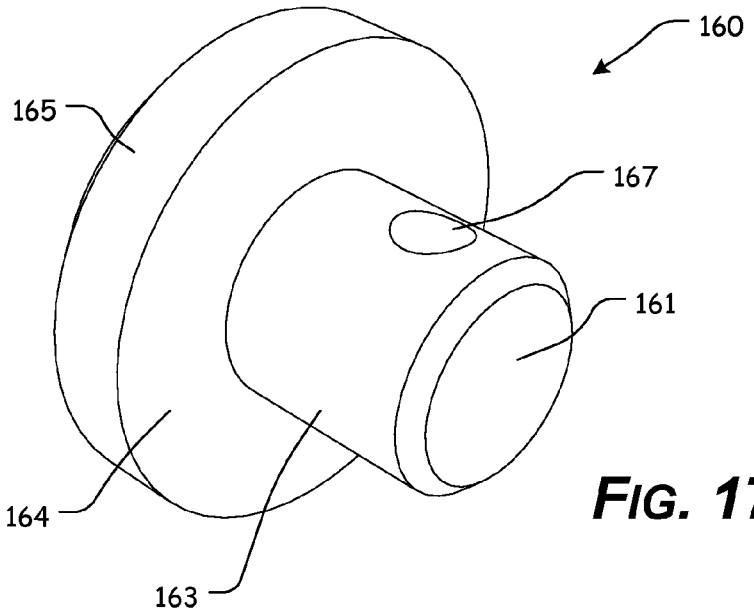
FIG. 17 illustrates an upper, front perspective view of an exemplary embodiment of a bumper, according to the presently disclosed systems, methods, and/or apparatuses.
Figure 18:
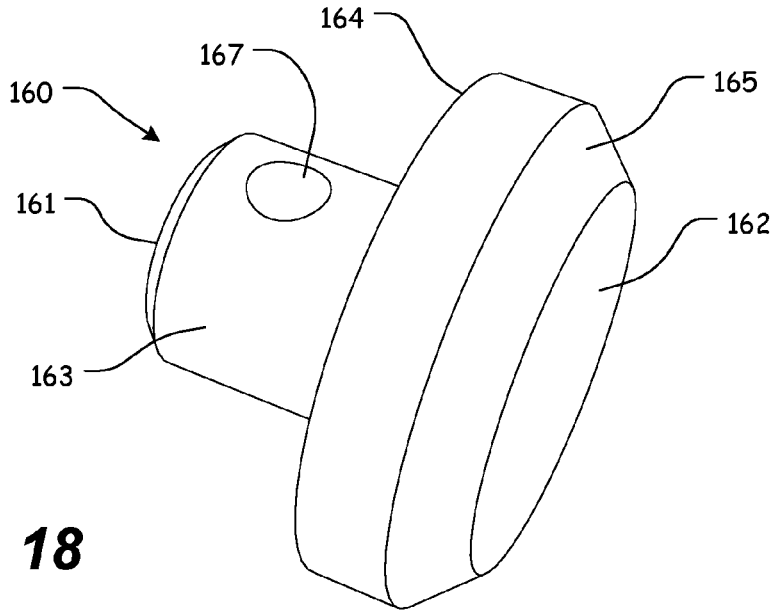
FIG. 18 illustrates an upper, rear perspective view of an exemplary embodiment of a bumper, according to the presently disclosed systems, methods, and/or apparatuses.
Figure 19:
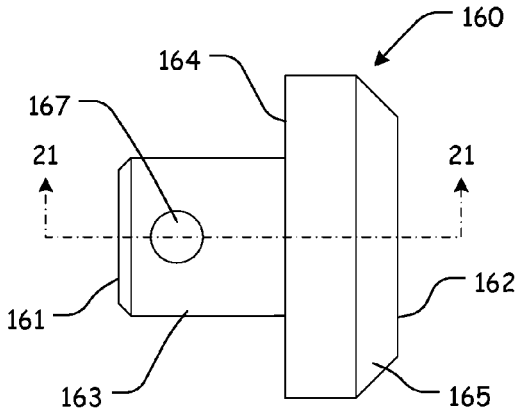
FIG. 19 illustrates a top view of an exemplary embodiment of a bumper, according to the presently disclosed systems, methods, and/or apparatuses.
Figure 20:
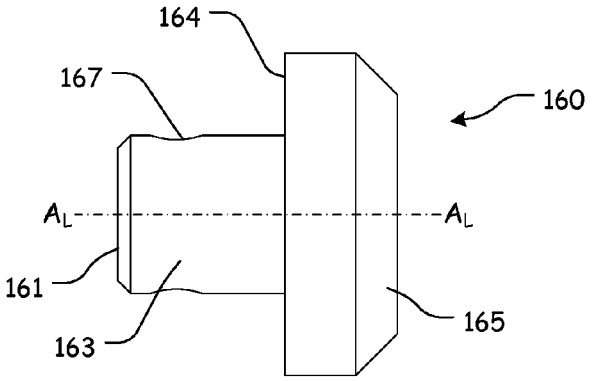
FIG. 20 illustrates a side view of an exemplary embodiment of a bumper, according to the presently disclosed systems, methods, and/or apparatuses.
Figure 21:
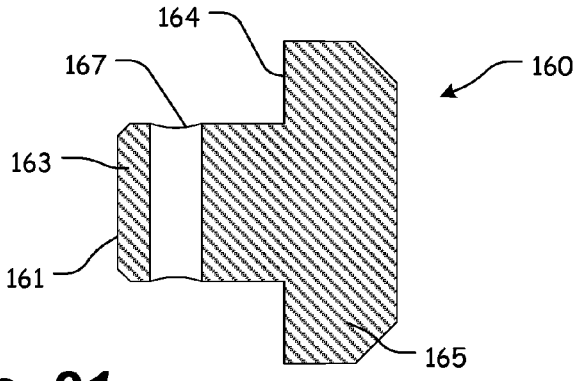
FIG. 21 illustrates a cross-sectional view taken along line 21-21 of the bumper of FIG. 19, according to the presently disclosed systems, methods, and/or apparatuses.
Figure 22:
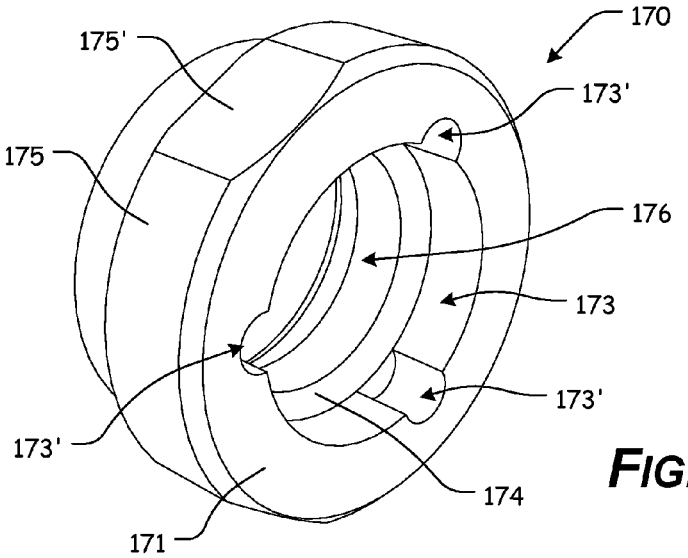
FIG. 22 illustrates an upper, front perspective view of an exemplary embodiment of a collar, according to the presently disclosed systems, methods, and/or apparatuses.
Figure 23:
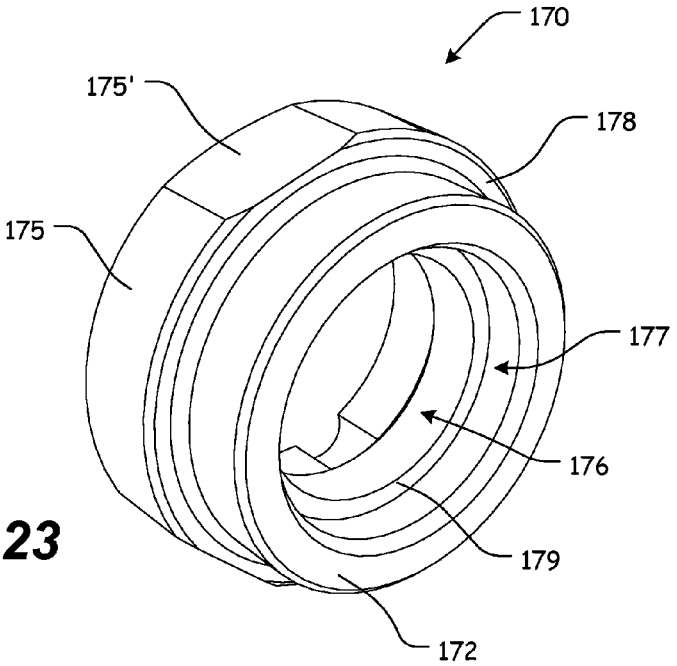
FIG. 23 illustrates an upper, rear perspective view of an exemplary embodiment of a collar, according to the presently disclosed systems, methods, and/or apparatuses.
Figure 24:
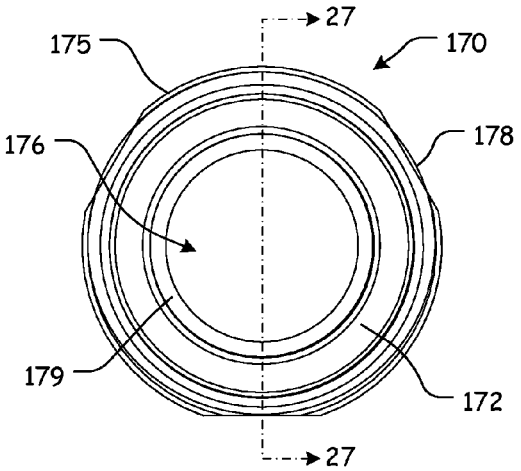
FIG. 24 illustrates a rear view of an exemplary embodiment of a collar, according to the presently disclosed systems, methods, and/or apparatuses.
Figure 25:
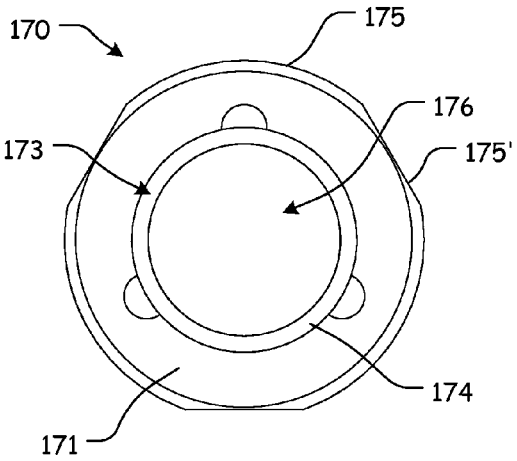
FIG. 25 illustrates a front view of an exemplary embodiment of a collar, according to the presently disclosed systems, methods, and/or apparatuses.
Figure 26:
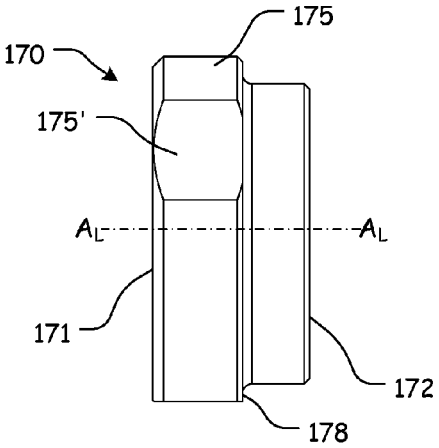
FIG. 26 illustrates a side view of an exemplary embodiment of a collar, according to the presently disclosed systems, methods, and/or apparatuses.
Figure 27:
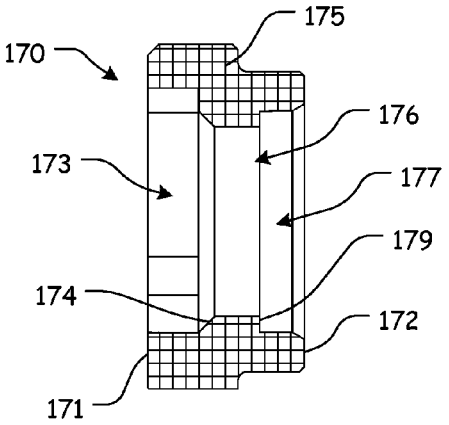
FIG. 27 illustrates a cross-sectional view taken along line 27-27 of the collar of FIG. 24, according to the presently disclosed systems, methods, and/or apparatuses.
Figure 28:
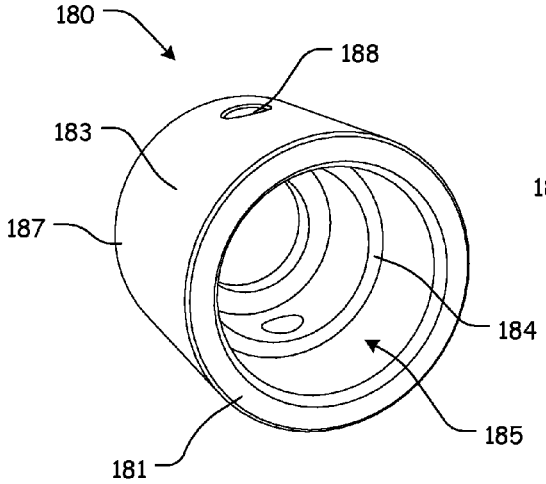
FIG. 28 illustrates an upper, front perspective view of an exemplary embodiment of a sleeve, according to the presently disclosed systems, methods, and/or apparatuses.
Figure 29:
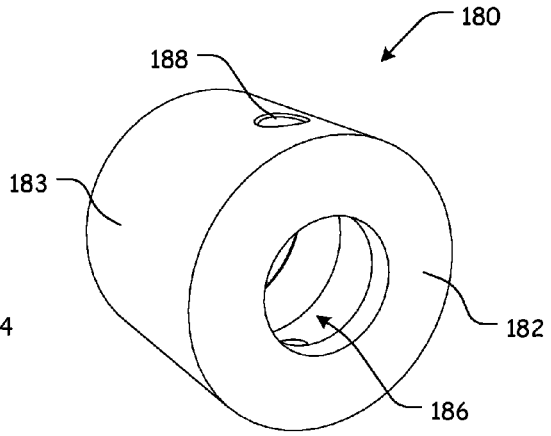
FIG. 29 illustrates an upper, rear perspective view of an exemplary embodiment of a sleeve, according to the presently disclosed systems, methods, and/or apparatuses.
Figure 30:
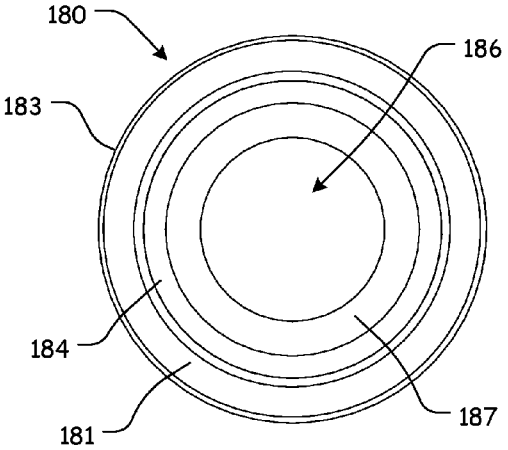
FIG. 30 illustrates a front view of an exemplary embodiment of a sleeve, according to the presently disclosed systems, methods, and/or apparatuses.
Figure 31:
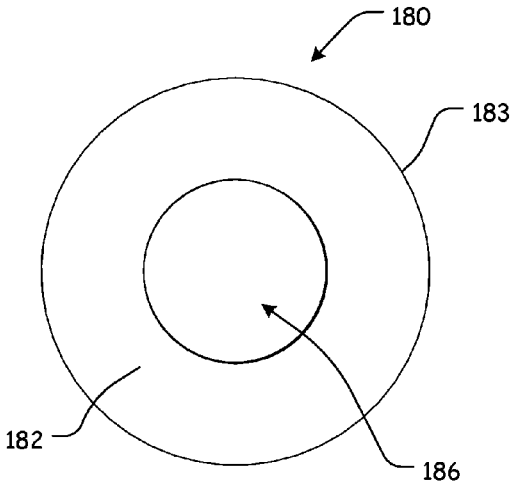
FIG. 31 illustrates a rear view of an exemplary embodiment of a sleeve, according to the presently disclosed systems, methods, and/or apparatuses.
Figure 32:
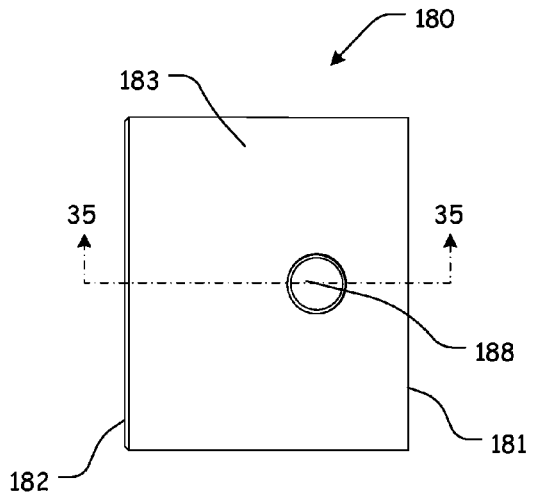
FIG. 32 illustrates a top view of an exemplary embodiment of a sleeve, according to the presently disclosed systems, methods, and/or apparatuses.
Figure 33:
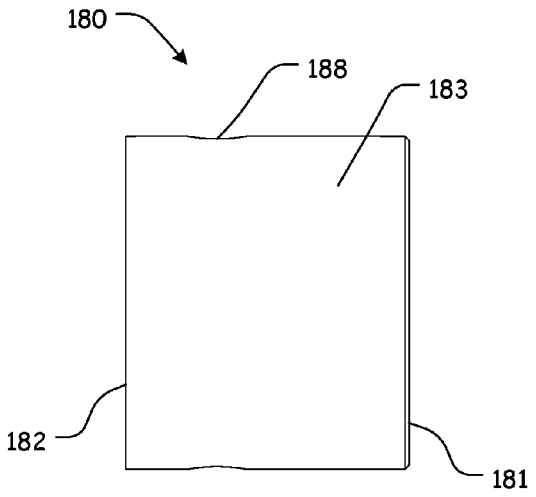
FIG. 33 illustrates a right side view of an exemplary embodiment of a sleeve, according to the presently disclosed systems, methods, and/or apparatuses.
Figure 34:
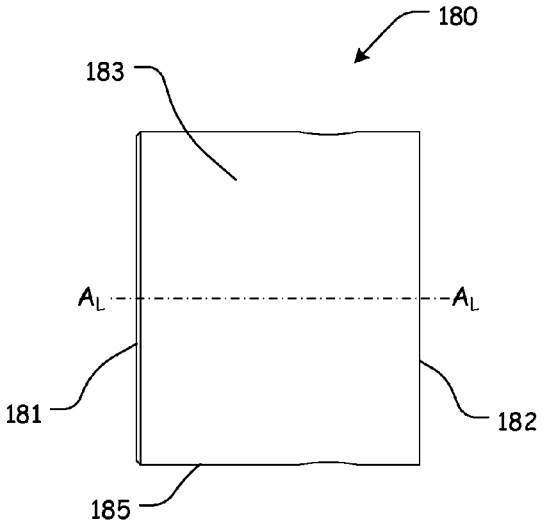
FIG. 34 illustrates a left side view of an exemplary embodiment of a sleeve, according to the presently disclosed systems, methods, and/or apparatuses.
Figure 35:
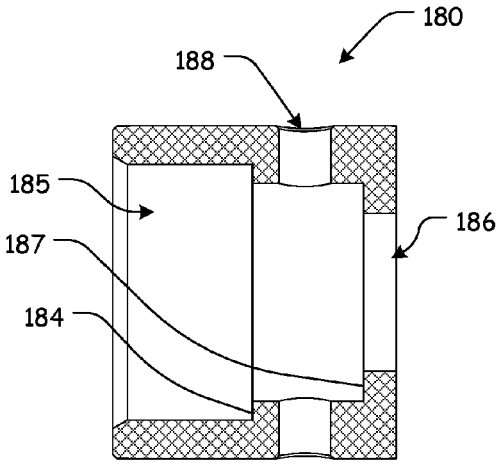
FIG. 35 illustrates a cross-sectional view taken along line 35-35 of the sleeve of FIG. 32, according to the presently disclosed systems, methods, and/or apparatuses.
Figure 36:
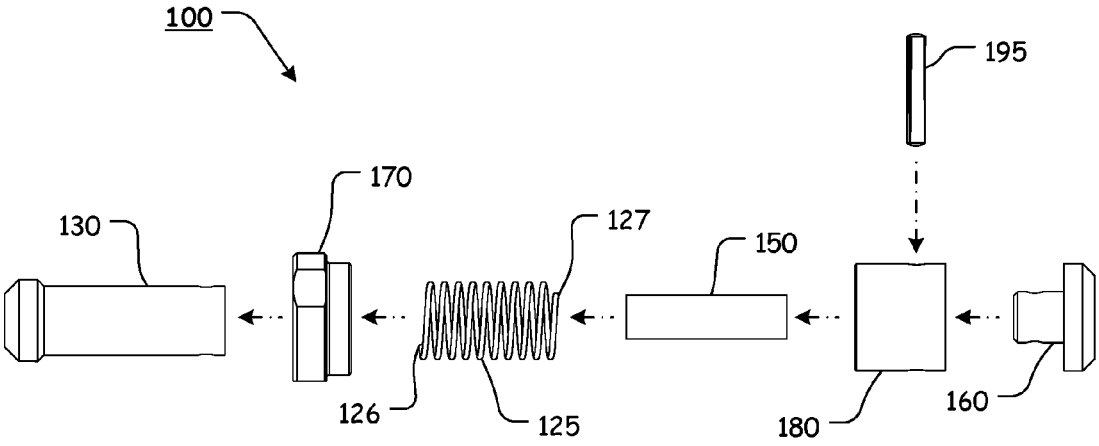
FIG. 36 illustrates an left side, exploded view of certain exemplary components of an exemplary embodiment of a recoil buffer system, according to the presently disclosed systems, methods, and/or apparatuses.
Figure 37:
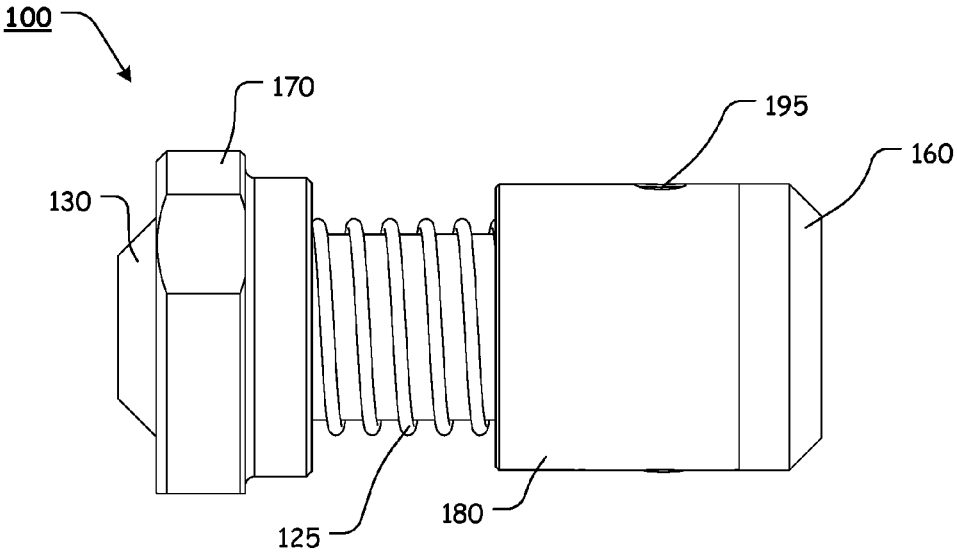
FIG. 37 illustrates an left side view of an exemplary embodiment of an assembled, recoil buffer system, according to the presently disclosed systems, methods, and/or apparatuses.
Figure 38:
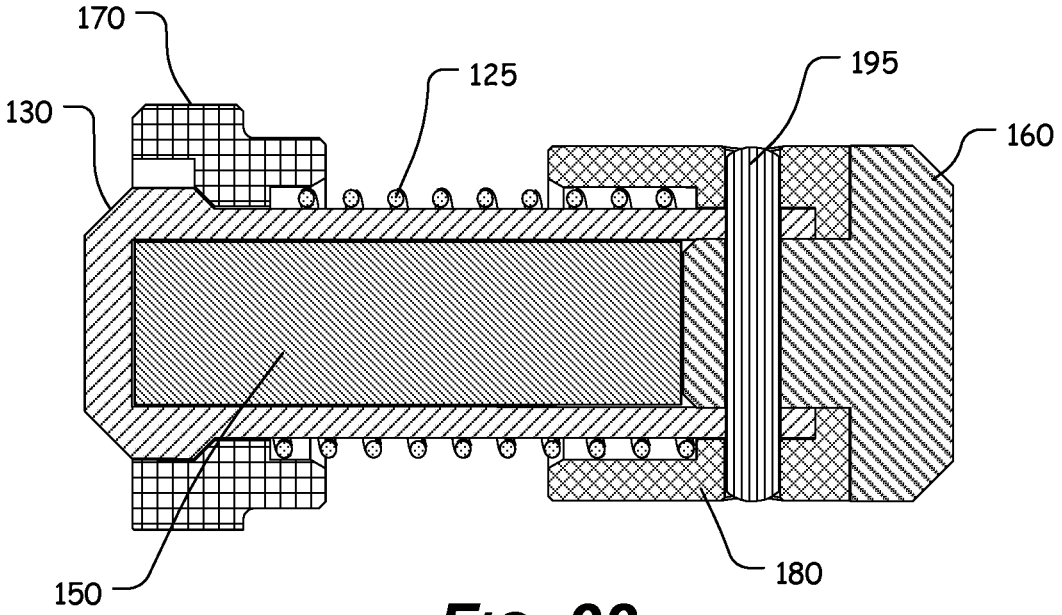
FIG. 38 illustrates an left side, cross-sectional view of an exemplary embodiment of an assembled, recoil buffer system, according to the presently disclosed systems, methods, and/or apparatuses, wherein the components are in an uncompressed position.
Figure 39:
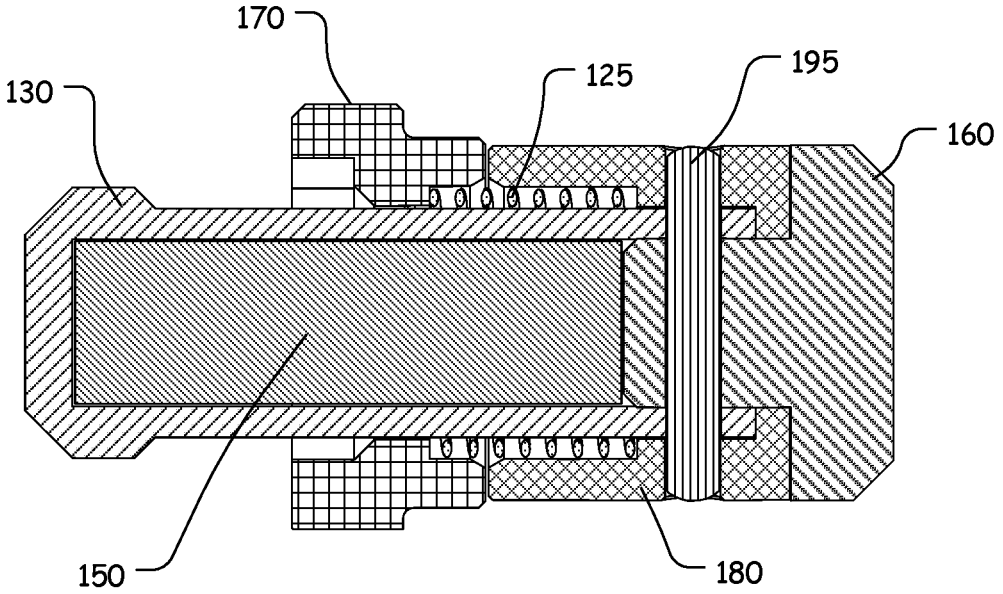
FIG. 39 illustrates an left side, cross-sectional view of an exemplary embodiment of an assembled, recoil buffer system, according to the presently disclosed systems, methods, and/or apparatuses, wherein the components are in a fully compressed position.
Figure 40:
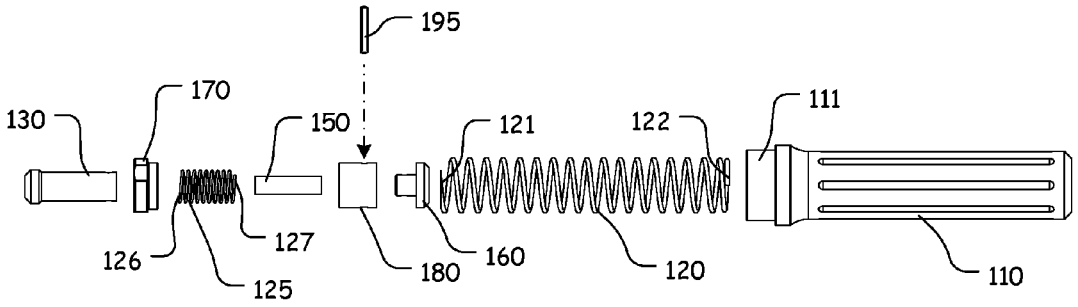
FIG. 40 illustrates an left side, exploded view of certain exemplary components of an exemplary embodiment of a recoil buffer system, according to the presently disclosed systems, methods, and/or apparatuses.
Figure 41:
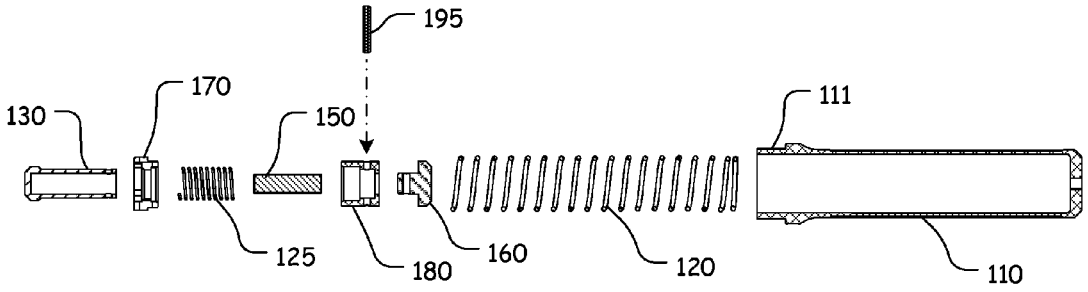
FIG. 41 illustrates an left side, cross-sectional, exploded view of certain exemplary components of an exemplary embodiment of a recoil buffer system of FIG. 40, according to the presently disclosed systems, methods, and/or apparatuses.
Figure 42:
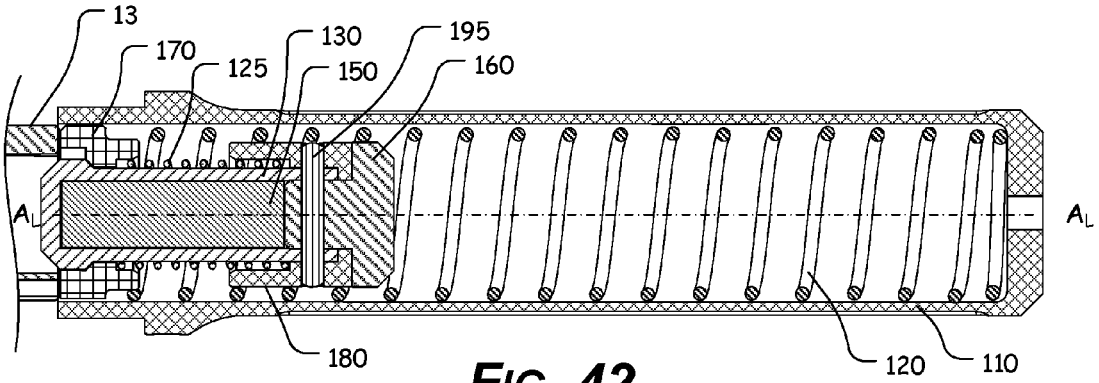
FIG. 42 illustrates an left side, cross-sectional view of certain exemplary components of an exemplary embodiment of a recoil buffer system, assembled according to the presently disclosed systems, methods, and/or apparatuses, wherein the components are in a normal, installed position.

For simplicity and clarification, the design factors and operating principles of the recoil buffer system according to the presently disclosed systems, methods, and/or apparatuses are explained with reference to various exemplary embodiments of a recoil buffer system according to the presently disclosed systems, methods, and/or apparatuses. The basic explanation of the design factors and operating principles of the recoil buffer system is applicable for the understanding, design, and operation of the recoil buffer system of the presently disclosed systems, methods, and/or apparatuses. It should be appreciated that the recoil buffer system can be adapted to many applications where a recoil buffer system or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "recoil buffer system", "buffer assembly", "lower receiver", and "firearm" are used for basic explanation and understanding of the operation of the presently disclosed systems, methods, and/or apparatuses. Therefore, the terms "recoil buffer system", "buffer assembly", "lower receiver", and "firearm" are not to be construed as limiting the systems, methods, and/or apparatuses of the present disclosure. Thus, for example, the term "lower receiver" is to be understood to broadly include any upper, lower, or combined receiver for a firearm or other similar handheld or shoulder mounted device or tool.

For simplicity and clarification, the recoil buffer system of the present disclosure will be described as being used in conjunction with a firearm, such as an AR-15 or M4 style rifle or carbine. However, it should be appreciated that these are merely exemplary embodiments of the recoil buffer system and are not to be construed as limiting the presently disclosed systems, methods, and/or apparatuses. Thus, the recoil buffer system of the present disclosure may be utilized in conjunction with any firearm or rifle, such as, for example, an AR-10 style rifle, air rifle, paintball marker, Airsoft rifle, replica rifle, or any other tool, device, or object.

Turning now to the drawing FIGS., as discussed above, FIG. 1-4 illustrate various components of known buffer tubes. FIGS. 5-48 illustrate certain elements and/or aspects of an exemplary embodiment of the recoil buffer system 100, according to the presently disclosed systems, methods, and/or apparatuses. In illustrative, non-limiting embodiment (s) of the present disclosure, as illustrated in FIGS. 5-48, the recoil buffer system 100 comprises at least some of a receiver extension or buffer tube 110, a buffer tube recoil spring 120, a buffer element recoil spring 125, a buffer element 130, a weight 150, a bumper 160, a collar 170, and a sleeve 180.

As illustrated most clearly in FIGS. 5-9, the receiver extension or buffer tube 110 comprises an elongate portion of material extending, along a longitudinal axis $A_L$, from a first end to a second end and having a substantially cylindrical internal cavity 115 defined by one or more side walls 113 and a bottom wall 114. The internal cavity 115 extends from the bottom wall 114, along the one or more side walls 113, to an open end 112.

In various exemplary embodiments, the buffer tube 110 includes an externally threaded portion 111, which extends from the first end. The externally threaded portion 111, if included, allows the buffer tube 110 to be threadedly attached or connected to the lower receiver 10, via interaction of the externally threaded portion 111 of the buffer tube 110 and an internally threaded buffer tube receiving aperture 11 of the lower receiver 10.

Alternatively, the portion of the buffer tube 110 represented by the externally threaded portion 111 may comprise a smooth or textured surface that allows the buffer tube 110 to be welded or adhesively attached or coupled to a corresponding buffer tube receiving aperture of a lower receiver. Thus, the buffer tube 110 may be attached, connected, or coupled to a lower receiver in any desired manner. In still other exemplary embodiments, the buffer tube 110 may be formed as an integral component of a lower receiver.

The overall length of the buffer tube 110 is substantially shorter than a known, typical buffer tube 5. Thus, the buffer tube 110 can be utilized in conjunction with, for example, retractable buttstocks that provide a shorter overall length to the buttstock assembly and/or firearm. Alternatively, the buffer tube 110 can be utilized in conjunction with certain pistol configurations to provide a shorter overall length to the firearm.

In various exemplary embodiments, the buffer tube 110 is substantially rigid and is formed of aluminum. Alternate materials of construction of the buffer tube 110 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the buffer tube 110 is a design choice based on the desired appearance and/or functionality of the buffer tube 110.

The buffer tube recoil spring 120 extends from a first end 121 to a second end 122. In various exemplary embodiments, the buffer tube recoil spring 120 comprises a standard AR buffer spring, having a reduced length. In certain exemplary, nonlimiting embodiments, the buffer tube recoil spring 120 comprises a standard AR buffer spring that has been shortened.

The buffer element recoil spring 125 extends from a first end to a second end. The buffer element recoil spring 125 has an external diameter that is less than an internal diameter of the buffer tube recoil spring 120. In this manner, when assembled, the buffer element recoil spring 125 can be fitted within the buffer tube recoil spring 120.

In various exemplary embodiments, the buffer element recoil spring 125 may optionally have a spring rate or spring biasing force that is less than a spring rate or spring biasing force of the buffer tube recoil spring 120. In other exemplary embodiments, the buffer element recoil spring 125 may optionally have a spring rate or spring biasing force that is greater than a spring rate or spring biasing force of the buffer tube recoil spring 120. In still other exemplary embodiments, the buffer element recoil spring 125 may optionally have a spring rate or spring biasing force that is equal to a spring rate or spring biasing force of the buffer tube recoil spring 120. Thus, it should be appreciated that the spring rates or spring biasing forces of the buffer element recoil spring 125 and the buffer tube recoil spring 120 may be the same or may be different from one another.

It should be appreciated that the overall size and characteristics of the buffer tube recoil spring 120 and the buffer element recoil spring 125 are designed choices based upon the desired performance of the buffer tube recoil spring 120 and the buffer element recoil spring 125. Additionally, the buffer tube recoil spring 120 and the buffer element recoil spring 125 may be formed of steel, spring-tempered steel, brass, phosphor bronze, or any other desired material.

In certain exemplary embodiments, the combined spring rate or spring biasing force of the buffer tube recoil spring 120 and the buffer element recoil spring 125 is approximately equivalent to the spring biasing force of a standard, MIL-SPEC carbine buffer spring rate or spring biasing force.

As illustrated most clearly in FIGS. 10-16, the buffer element 130 comprises a buffer element body portion 135 and a buffer element knob 137. The buffer element 130 comprises an elongate portion of material extending, along a longitudinal axis $A_L$, from a first end 131 to a second end 132.

In various exemplary embodiments, the buffer element 130 includes a buffer element cavity 139 defined by one or more side walls 139' and a bottom wall 139". The buffer element cavity 139 extends from the bottom wall 139", along the one or more side walls 139', to an open end 138.

In various exemplary, nonlimiting embodiments, the buffer element 130 is formed of a partially or substantially solid portion of material and only includes a buffer element cavity 139 of a sufficient size to accept at least a portion of the bumper extension portion 163 of the end 160.

In these exemplary, nonlimiting embodiments, the manufacturing time and cost of the buffer element 130 may be reduced. Furthermore, a solid buffer element 130 may provide sufficient weigh to be close to the reciprocating mass of a standard, MIL-SPEC carbine buffer.

The buffer element body portion 135 extends from the second end 132 to a bulbous portion or buffer element knob 137. The buffer element knob 137 has a larger outer diameter than an outer diameter of the buffer element body portion 135.

In various exemplary embodiments, an optional second buffer element chamfer 136 is formed as a transitional edge or plane between the first end 131 and the outer surface of the buffer element knob 137. The second buffer element chamfer 136 provides a transition between the buffer element body portion 135 and the buffer element knob 137. In various exemplary embodiments, the second buffer element chamfer 136 extends at an angle that is approximately 135° relative to the longitudinal axis $A_L$, of the buffer element 130. Alternatively, the second buffer element chamfer 136 may extend at an angle that is equal to, greater than, or less than 135° relative to the longitudinal axis $A_L$, of the buffer element 130. For example, the second buffer element chamfer 136 may extend at an angle that is approximately 155°, 150°, 145°, 140°, 135°, 130°, 125°, 120°, or 115° relative to the longitudinal axis $A_L$, of the buffer element 130.

An optional first buffer element chamfer 133 is formed as a transitional edge or plane between the buffer element knob 137 and the first end 131 of the buffer element 130. The first buffer element chamfer 133 provides a transition between the buffer element knob 137 and the first end 131 of the buffer element 130. In various exemplary embodiments, the first buffer element chamfer 133 extends at an angle that is approximately 45° relative to the longitudinal axis $A_L$, of the buffer element 130. Alternatively, the first buffer element chamfer 133 may extend at an angle that is equal to, greater than, or less than 45° relative to the longitudinal axis $A_L$, of the buffer element 130. For example, the first buffer element chamfer 133 may extend at an angle that is approximately 25°, 30°, 35°, 40°, 45°, 50°, 55°, 60°, or 65° relative to the longitudinal axis $A_L$, of the buffer element 130.

A buffer element retaining pin aperture 191 extends at least partially through the buffer element body portion 135, proximate the second end 132 and is formed so as to accept at least a portion of a retaining pin 195 therethrough.

In various exemplary embodiments, the buffer element 130 is substantially rigid and is formed of stainless steel. Alternate materials of construction of the buffer element 130 may include one or more of the following: steel, aluminum, titanium, and/or other metals, as well as various alloys and composites thereof. Thus, it should be understood that the material or materials used to form the buffer element 130 is a design choice based on the desired appearance and/or functionality of the buffer element 130.

The weight 150 is generally cylindrical in shape and is sized so as to be fitted within the buffer element cavity 139 of the buffer element 130. The actual weight of the weight 150 can vary, depending upon the desired functionality of the weight 150 and the overall functional weight of the buffer element 130. In various exemplary embodiments, the weight 150 may comprise a portion of stainless steel or tungsten rod. Alternatively, the weight 150 may comprise a solid portion of material, a powdered or granulated material (such as, for example, loose sand, lead, steel, or other metallic or nonmetallic shot), or a liquid (such as, for example, Mercury).

As illustrated most clearly in FIGS. 17-21, the bumper 160 comprises a portion of material extending, along a longitudinal axis $A_L$, from a first end 161 to a second end 162. In various exemplary embodiments, a bumper extension portion 163 extends rearward from the first end 161. The bumper extension portion 163 extends from the first end 161 to a bumper shoulder 164. In various exemplary embodiments, the bumper extension portion 163 extends parallel to the longitudinal axis $A_L$, of the bumper 160 and the bumper shoulder 164 extends perpendicular to the longitudinal axis $A_L$, of the bumper 160. Alternatively, the bumper shoulder 164 may extend at an angle that is equal to, greater than, or less than 90° relative to the longitudinal axis $A_L$, of the bumper 160.

The outer size and shape of the bumper extension portion 163 is such that at least a portion of the bumper extension portion 163 can be fitted through the open end 138 of the buffer element cavity 139 and positioned within at least a portion of the buffer element cavity 139.

A bumper head portion 165 extends rearward from the bumper shoulder 164 to the second end 162. In various exemplary embodiments, the bumper head portion 165 has an overall dome or a tapered shape. Alternatively, the bumper head portion 165 may comprise a generally cylindrical overall shape.

In various exemplary embodiments, the bumper head portion 165 has a larger outer diameter or size than an outer diameter or size of the bumper extension portion 163. Thus, the bumper shoulder 164 provides a transition between the bumper head portion 165 and the bumper extension portion 163.

A bumper retaining aperture 167 extends at least partially through the bumper extension portion 163 and is formed so as to accept at least a portion of a retaining pin 195 therethrough.

In various exemplary embodiments, the bumper 160 is substantially rigid and is formed of urethane. Alternatively, the bumper 160 may be substantially deformable or flexible and alternate materials of construction of the bumper 160 may include one or more of the following: rubber, silicone, plastic, self-lubricating plastic, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations or variations of the foregoing. Thus, it should be understood that the material or materials used to form the bumper 160 is a design choice based on the desired appearance and/or functionality of the bumper 160.

As illustrated most clearly in FIGS. 22-27, the collar 170 comprises a portion of material extending, along a longitudinal axis $A_L$, from a first end 171 to a second end 172. A collar aperture 176 is formed through the collar 170, along the longitudinal axis $A_L$. A substantially cylindrical collar recess 173 extends from the first end 171 and is defined by one or more side walls and a collar recess shoulder 174. The collar recess 173 is formed so as to accept at least a portion of the buffer element knob 137 therein.

In various exemplary embodiments, the collar recess shoulder 174 extends perpendicular to the longitudinal axis $A_L$, of the collar 170. Alternatively, as illustrated, the collar recess shoulder 174 may extend at an angle that is greater than or less than 90° relative to the longitudinal axis $A_L$, of the collar 170. Generally, the collar recess 173 is formed so as to accept at least a portion of the buffer element knob 137 therein and the collar recess shoulder 174 is formed so as to mate with at least a portion of the second buffer element chamfer 136, when the buffer element knob 137 is at least partially seated within the collar recess 173.

In certain exemplary embodiments, one or more recesses or notches 173' extend from the collar recess 173. If included, the recesses or notches 173 provide debris channels, such that any matter or debris that comes between the collar 170 and the buffer element 130 can be diverted into the recesses or notches 173', so as not to hinder the movement of the collar 170 in relation to the buffer element 130.

In various exemplary embodiments, the collar aperture 176 has a diameter that is less than a diameter of the collar recess 173 and allows the buffer element body portion 135 to be slidable within the collar aperture 176.

A substantially cylindrical collar spring recess 177 extends from the second end 172 and is defined by one or more side walls and a collar spring recess shoulder 179. The collar spring recess 177 is formed so as to accept at least a portion of the buffer element recoil spring 125 therein.

In various exemplary embodiments, as illustrated, the collar spring recess shoulder 179 extends perpendicular to the longitudinal axis $A_L$, of the collar 170. Alternatively, the collar spring recess shoulder 179 may extend at an angle that is greater than or less than 90° relative to the longitudinal axis $A_L$, of the collar 170. Generally, the collar spring recess shoulder 179 is formed so as to be a contact surface for the second end 126 of the buffer element recoil spring 125, when the buffer element recoil spring 125 is at least partially seated within the collar spring recess 177.

In various exemplary embodiments, the collar 170 has a substantially circular profile, when viewed from the front or rear. In various exemplary embodiments, one or more grooves, notches, or flats 175' are formed at various locations around the collar 170. If included, the flats 175' may optionally reduce the overall weight of the collar 170, provide less friction to the collar 170, and/or provide areas for dirt, debris, or other material to pass by portions of the collar 170. It should be appreciated that the overall profile of the collar 170 may comprise for example, an overall profile resembling that of a circle, triangle, square, pentagon, hexagon, heptagon, octagon, star shape, or other desired shape.

Regardless of the overall shape or profile of the collar 170, the outer diameter or extent of the collar 170 is such that the collar 170 fits within and is slidable within the internal cavity 115 of the buffer tube 110.

In various exemplary embodiments, the collar 170 is substantially rigid and is formed of aluminum. Alternate materials of construction of the collar 170 may include one or more of the following: steel, stainless steel, titanium, and/or other metals, as well as various alloys and composites thereof. Thus, it should be understood that the material or materials used to form the collar 170 is a design choice based on the desired appearance and/or functionality of the collar 170.

As illustrated most clearly in FIGS. 28-35, the sleeve 180 comprises a portion of material forming a sleeve body 183 that extends, along a longitudinal axis $A_L$, from a first end 181 to a second end 182. A sleeve aperture 186 is formed through the sleeve 180, along the longitudinal axis $A_L$. The sleeve aperture 186 is formed so as to accept at least a portion of the bumper 160 therein.

In various exemplary embodiments, the vertices of the first end 181 and the sleeve body 183 meet at a right angle, or 90°. Likewise, the vertices of the second end 182 and the sleeve body 183 meet at a right angle, or 90°.

A substantially cylindrical sleeve spring recess 185 extends from the first end 181 and is defined by one or more side walls and a sleeve spring recess shoulder 184. The sleeve spring recess 185 is formed so as to accept at least a portion of the buffer element body portion 135 therein, such that the sleeve retaining pin aperture 188 may be aligned with the buffer element retaining pin aperture 191 and the bumper retaining aperture 167.

In various exemplary embodiments, as illustrated, the sleeve spring recess shoulder 184 extends substantially perpendicular to the longitudinal axis $A_L$, of the sleeve 180. Alternatively, the sleeve spring recess shoulder 184 may extend at an angle that is greater than or less than 90° relative to the longitudinal axis $A_L$, of the sleeve 180. Generally, the sleeve spring recess 185 is formed so as to accept at least a portion of the buffer element body portion 135 therein and the sleeve spring recess shoulder 184 is formed so as to mate with at least a portion of the second end 132 of the buffer element 130, when the buffer element body portion 135 is at least partially seated within the sleeve spring recess 185.

In various exemplary embodiments, the sleeve aperture 186 has a diameter that is less than a diameter of the sleeve spring recess 185 and allows the buffer element body portion 135 to be slidable within the sleeve spring recess 185, until the second end 132 of the buffer element 130 contacts the sleeve spring recess shoulder 184.

It should be appreciated that the outer diameter and shape of the sleeve body 183 is such that the sleeve 180 fits within and is slidable within the internal cavity 115 of the buffer tube 110.

A sleeve retaining pin aperture 188 extends at least from an outer surface of the sleeve body 183 into the sleeve aperture 186. In various exemplary embodiments, the sleeve retaining pin aperture 188 extends from a first side of the outer surface of the sleeve body 183, through the sleeve aperture 186, and through a second side of the outer surface of the sleeve body 183.

In various exemplary embodiments, the sleeve 180 is substantially rigid and is formed of aluminum. Alternate materials of construction of the sleeve 180 may include one or more of the following: steel, stainless steel, titanium, and/or other metals, as well as various alloys and composites thereof. Thus, it should be understood that the material or materials used to form the sleeve 180 is a design choice based on the desired appearance and/or functionality of the sleeve 180.

As illustrated most clearly in FIGS. 36-47, the various components of the buffer assembly 100 are fitted together and the buffer tube 110 is attached or coupled to an exemplary lower receiver 10. As illustrated, during assembly, the buffer tube recoil spring 120 is inserted within the internal cavity 115 of the buffer tube 110. The buffer tube recoil spring 120 is inserted within the internal cavity 115 such that the second end 122 of the buffer tube recoil spring 120 is in contact with the bottom wall 114 of the internal cavity 115.

The collar 170 is slidably fitted about the buffer element body portion 135, via interaction of the collar aperture 176 and the buffer element body portion 135, such that the second buffer element chamfer 136 of the buffer element 130 contacts the collar recess shoulder 174 of the collar 170.

The weight 150, if included, is inserted within the buffer element cavity 139.

The buffer element recoil spring 125 is slidably fitted about the buffer element body portion 135, such that a portion of the recoil spring 125 is seated within the collar 170 and the second end 126 of the recoil spring 125 contacts the collar spring recess shoulder 179, which extends at least partially into the collar aperture 176 of the collar 170.

The sleeve 180 is slidably fitted about the buffer element body portion 135, via interaction of the buffer element body portion 135 and the sleeve spring recess 185, such that sleeve spring recess shoulder 187 of the sleeve 180 contacts the second end 132 of the buffer element 130.

At least a portion of the bumper extension portion 163 is fitted through the sleeve aperture 186 of the sleeve 180, such that the bumper retaining aperture 167 is aligned with the buffer element retaining pin aperture 191 and the sleeve retaining pin aperture 188. In this configuration, the bumper shoulder 164 optionally contacts the second end 132 of the buffer element 130.

Once the bumper 160 is appropriately positioned proximate the second end 132 of the buffer element 130, the retaining pin 195 is positioned through the bumper retaining aperture 167, the buffer element retaining pin aperture 191, and the sleeve retaining pin aperture 188.

When the sleeve 180 is attached or coupled to the buffer element 130, the buffer element recoil spring 125 is captured between the collar 170 and the sleeve 180, such that the second end 126 contacts the collar spring recess shoulder 179 and the first end 127 contacts the sleeve spring recess shoulder 184. Because of the spring biasing force of the buffer element recoil spring 125, the collar 170 is biased toward the first end 131 of the buffer element 130.

Once the relevant components are attached or coupled to the buffer element 130, the assembled buffer assembly 100 is positionable within the buffer tube recoil spring 120 such that the first end 121 of the buffer tube recoil spring 120 engages or contacts a shoulder 178 of the collar 170.

During a firing cycle, as most clearly illustrated in FIGS. 42-45, as the bolt carrier 13 is driven rearward, the rear of the bolt carrier 13 contacts the collar 170 and urges the collar 170 rearward, toward the bottom wall 114 of the buffer tube 110. The rearward force exerted on the collar 170 urges the collar 170 and, in turn, the buffer element 130 rearward, within the interior cavity 115 of the buffer tube 110.

Figure 43:
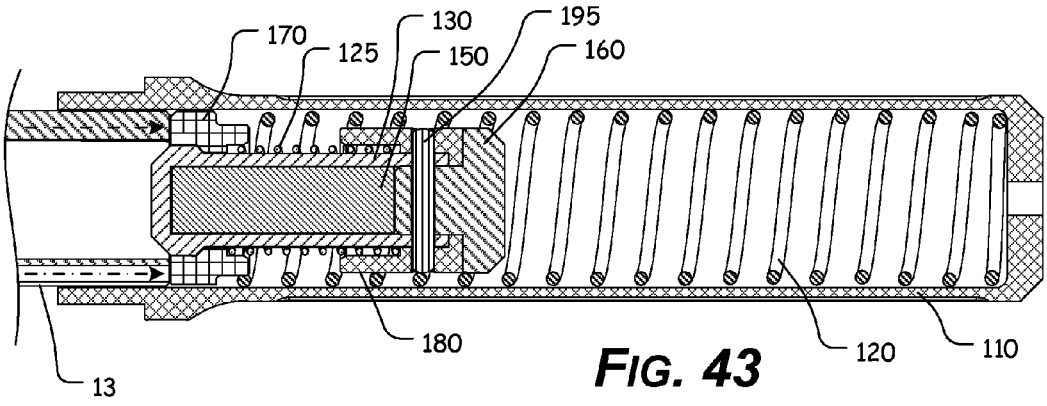
FIG. 43 illustrates an left side, cross-sectional view of certain exemplary components of an exemplary embodiment of a recoil buffer system, assembled according to the presently disclosed systems, methods, and/or apparatuses, wherein the components are in a partially compressed position.

As illustrated in FIG. 43, as the bolt carrier 13 continues to be driven rearward, the resilient spring biasing force of the buffer element recoil spring 125 continues to maintain the collar 170 in its position relative to the buffer element 130, as the bolt carrier 130 continues rearward.

Figure 44:
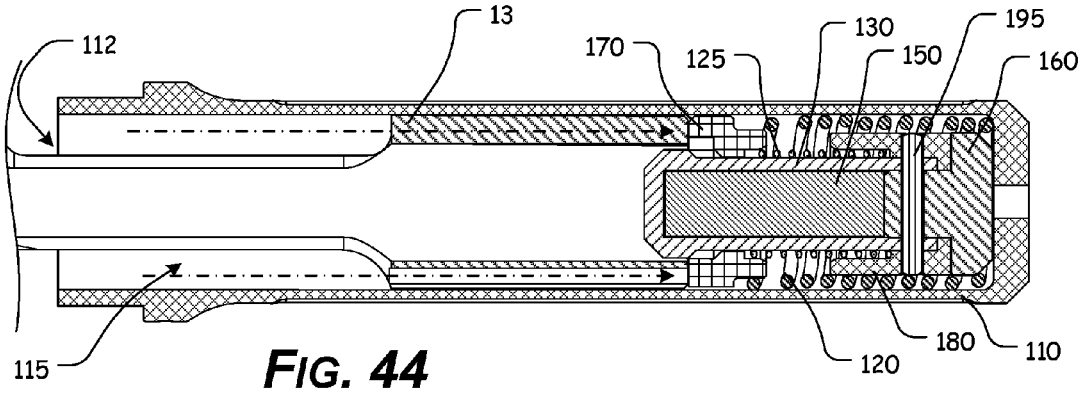
FIG. 44 illustrates an left side, cross-sectional view of certain exemplary components of an exemplary embodiment of a recoil buffer system, assembled according to the presently disclosed systems, methods, and/or apparatuses, wherein the components are in a further compressed position.

As illustrated in FIG. 44, as the bolt carrier 13 continues to be driven rearward, the second end 162 of the bumper 160 contacts the bottom wall 114 within the cavity 115 of the buffer tube 110. If this occurs, and if the recoil force continues to drive the bolt carrier 13 rearward, the spring biasing force of the buffer element recoil spring 125 is overcome and the collar 170 compresses the buffer element recoil spring 125 as it travels rearward, along the buffer element body portion 135.

When the buffer assembly 100 transitions to a compressed position, the collar 170 compresses the buffer element recoil spring 125 and at least a portion of the buffer element knob 137 (and/or a portion of the buffer element body portion 135) extends at least partially into an inside diameter of the bolt carrier 13.

Figure 45:
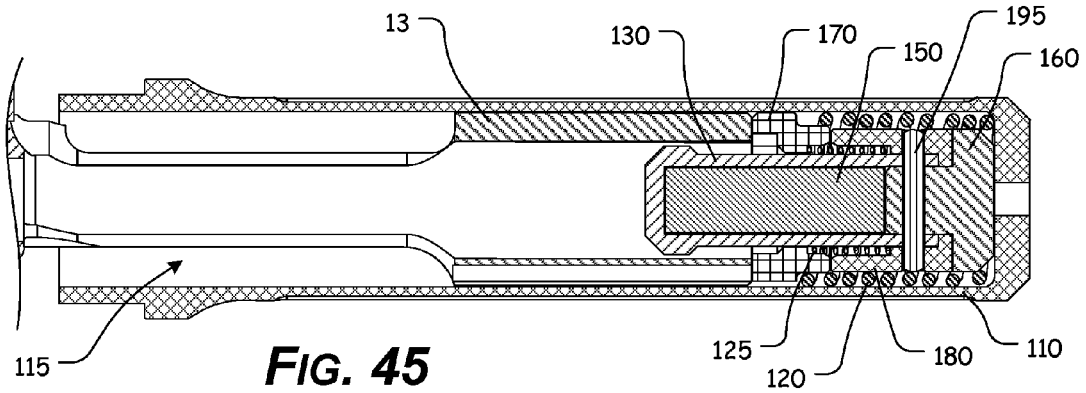
FIG. 45 illustrates an left side, cross-sectional view of certain exemplary components of an exemplary embodiment of a recoil buffer system, assembled according to the presently disclosed systems, methods, and/or apparatuses, wherein the components are in a fully compressed position.

If the bolt carrier 13 continues to drive rearward after the second end 162 of the bumper 160 contacts the bottom wall 114 of the buffer tube 110, the buffer element recoil spring 125 continues to compress, allowing the collar 170 to continue traveling rearward, along the buffer element body portion 135. The collar 170 is in a fully compressed position, as illustrated in FIG. 45, when the surface of the second end 172 of the collar 170 contacts the surface of the first end 181 of the sleeve 180.

If the buffer assembly 100 is in a fully compressed position, the compression of the buffer element recoil spring 125 is limited by the adjacent sleeve spring recess 185 and collar spring recess 177.

In a fully compressed position, at least a portion of the collar spring recess 177 is aligned with the sleeve spring recess 185 to form a substantially continuous spring recess. The depth of the collar spring recess 177 is defined between the second end 172 of the collar 170 and the collar spring recess shoulder 179. Similarly, the depth of the sleeve spring recess 185 is defined between the first end 181 of the sleeve 180 and the sleeve spring recess 185.

By defining the overall length of the continuous spring recess defined by the collar spring recess 177 and the sleeve spring recess 185, in a fully compressed position, the buffer element recoil spring 125 can only be compressed a determined amount. Thus, the continuous spring recess may be defined such that the buffer element recoil spring 125 maintains a determined travel distance. In certain exemplary embodiments, the determined travel distance is the safe travel distance for the buffer element recoil spring 125. The safe travel distance is the distance that the buffer element recoil spring 125 can be compressed without deforming or over compressing the buffer element recoil spring 125 or altering the desired, mechanical spring biasing properties of the buffer element recoil spring 125. Typically, the safe travel distance is greater than the fully compressed height of the buffer element recoil spring 125.

When the bolt carrier group reaches its rearmost position, the buffer tube recoil spring 120 and the buffer element recoil spring 125 both provide spring biasing force to the collar 170, urging the collar 170 and the buffer element 130 forward. When the collar 170 contacts the buffer element knob 137, the bolt carrier 13 and the buffer element 130 are urged forward with enough force to drive the bolt carrier 13 forward, toward the chamber, initiating chambering of the waiting round from the magazine into the chamber.

Thus, the buffer tube recoil spring 120 is first compressed by the rearward movement of the buffer element 130 (and more particularly the collar 170) until the buffer tube recoil spring 120 is about to bottom out (is almost fully compressed). Then, if the second end 162 of the bumper 160 contacts the bottom wall 114 within the cavity 115 of the buffer tube 110, the buffer element recoil spring 125 begins to compress. The buffer tube recoil spring 120 does not compress the buffer element recoil spring 125, the rearward movement of the collar 170 compress the buffer element recoil spring 125.

Each of the buffer element recoil spring 125, the buffer element 130, the weight 150 (if included), the bumper 160, the collar 170, and the sleeve 180 contributes to the reciprocating mass, or "dead blow" effect provided by the buffer assembly 100.

Figure 46:
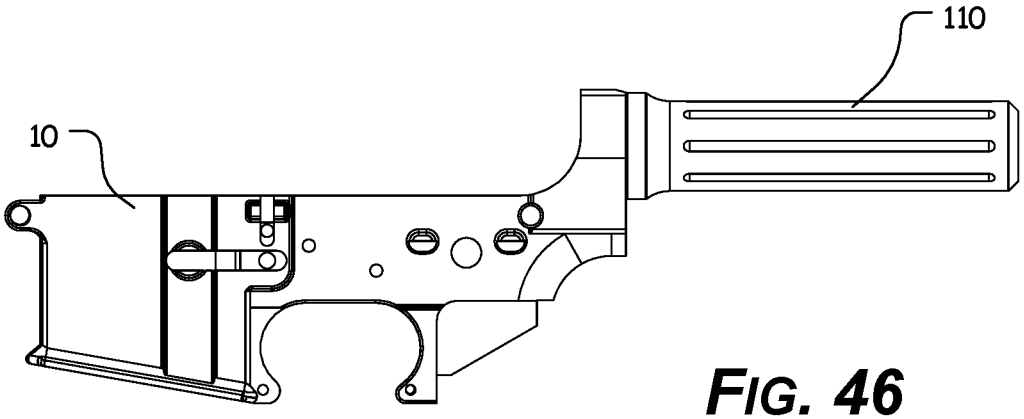
FIG. 46 illustrates a left side, view of an exemplary embodiment of a recoil buffer system being assembled together with a lower receiver, according to the presently disclosed systems, methods, and/or apparatuses.
Figure 47:
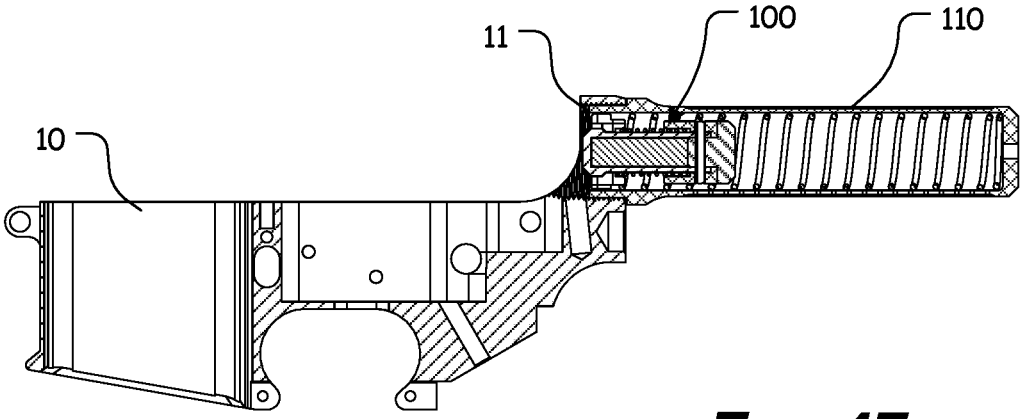
FIG. 47 illustrates a left side, cross-sectional view of certain exemplary components of an exemplary embodiment of a recoil buffer system being assembled together with a lower receiver, according to the presently disclosed systems, methods, and/or apparatuses.

As illustrated most clearly in FIGS. 46-47, the recoil buffer system 100 is illustrated as being utilized in conjunction with a lower receiver 10 and, further, being threadedly connected to the lower receiver 10 via interaction of an externally threaded portion 111 of the buffer tube 110 and an internally threaded buffer tube receiving aperture 11 of the lower receiver 10. It should be appreciated that the lower receiver 10 can be a typical lower receiver for a firearm. It should also be appreciated that a more detailed explanation of the lower receiver 10, the standard features and elements of a receiver that are not related to the present disclosure, instructions regarding how to assemble the lower receiver 10, and certain other items and/or techniques necessary for the implementation and/or operation of the various exemplary embodiments of the present disclosure are not provided herein because such elements are commercially available and/or such background information will be known to one of ordinary skill in the art. Therefore, it is believed that the level of description provided herein is sufficient to enable one of ordinary skill in the art to understand and practice the present disclosure, as described.

Figure 48:
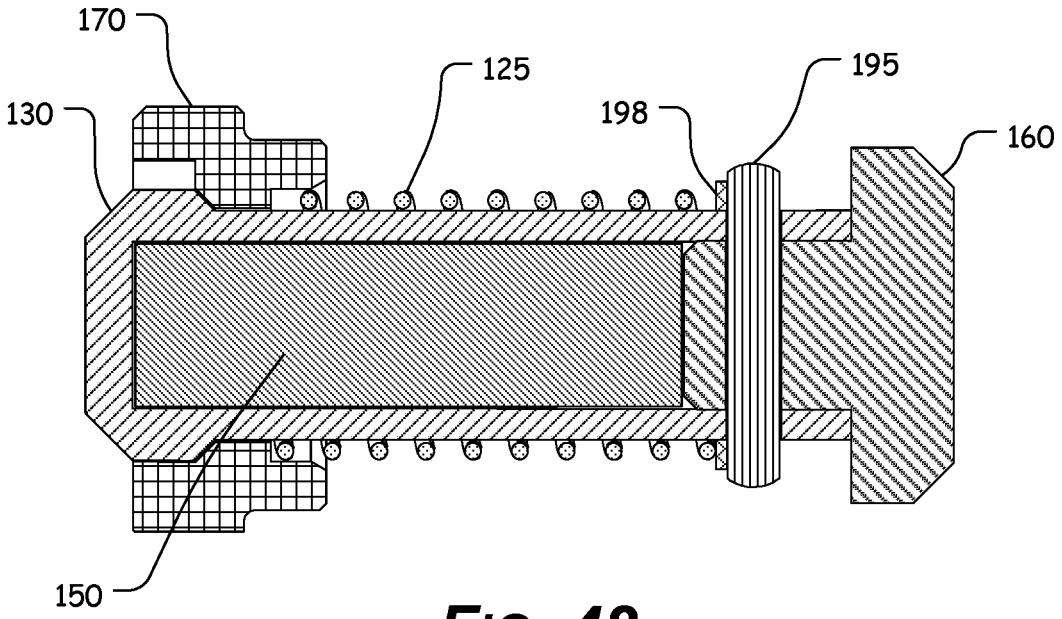
FIG. 48 illustrates a left side, cross-sectional view of an exemplary embodiment of an assembled, recoil buffer system, according to the presently disclosed systems, methods, and/or apparatuses.

FIG. 48 illustrates a left side, cross-sectional view of an exemplary embodiment of an assembled, recoil buffer system, according to the presently disclosed systems, methods, and/or apparatuses. As illustrated in FIG. 48, the sleeve 180 has been removed from the recoil buffer system.

As illustrated in FIG. 48, a washer 198 may optionally be positioned between the buffer element recoil spring and the retaining pin 195. However, the washer 198 is optional and, in certain exemplary embodiments, one or more portions of the first end 127 of the buffer element recoil spring 125 contact the retaining pin 195 to maintain the first end 127 of the buffer element recoil spring 125 in position.

Figure 49:
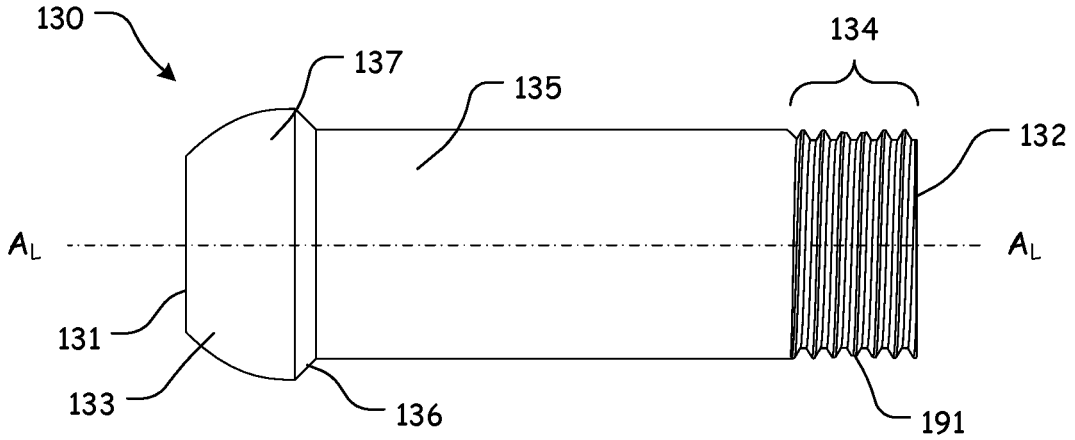
FIG. 49 illustrates a side view of an exemplary embodiment of a buffer element, according to the presently disclosed systems, methods, and/or apparatuses.
Figure 50:
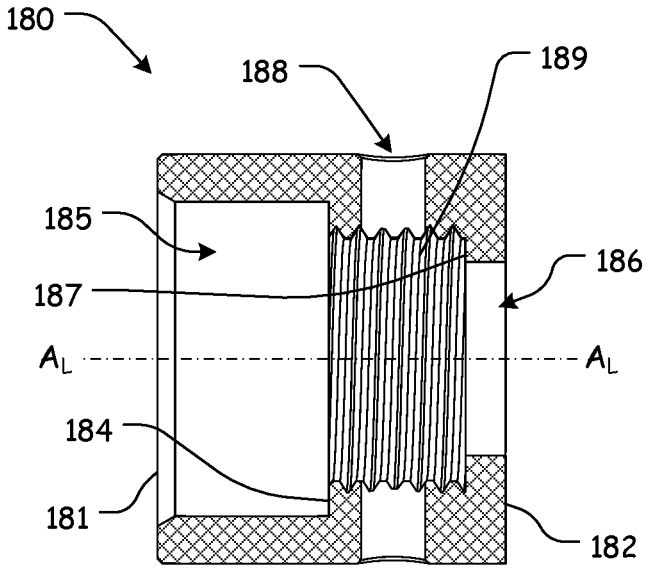
FIG. 50 illustrates a left side, cross-sectional view of an exemplary embodiment of a sleeve, according to the presently disclosed systems, methods, and/or apparatuses.
Figure 51:
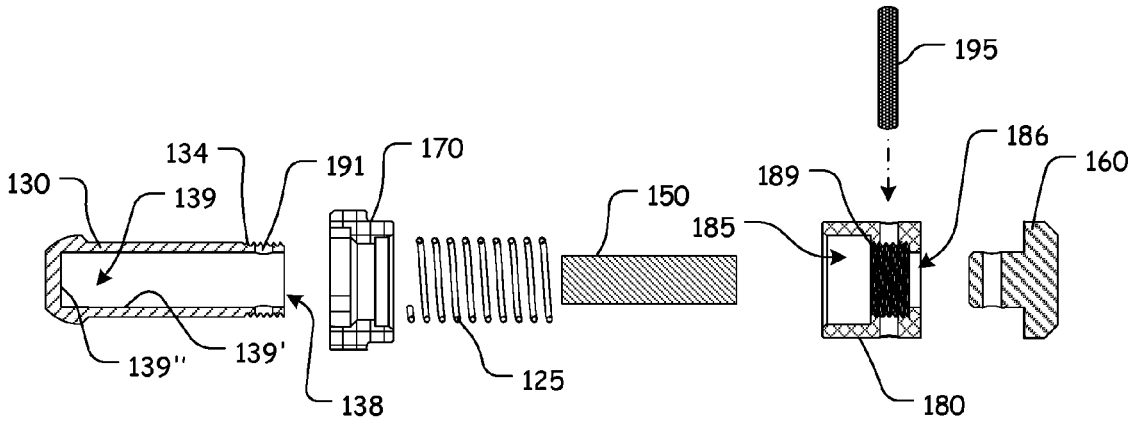
FIG. 51 illustrates an left side, exploded view of certain exemplary components of an exemplary embodiment of a recoil buffer system, according to the presently disclosed systems, methods, and/or apparatuses.
Figure 52:
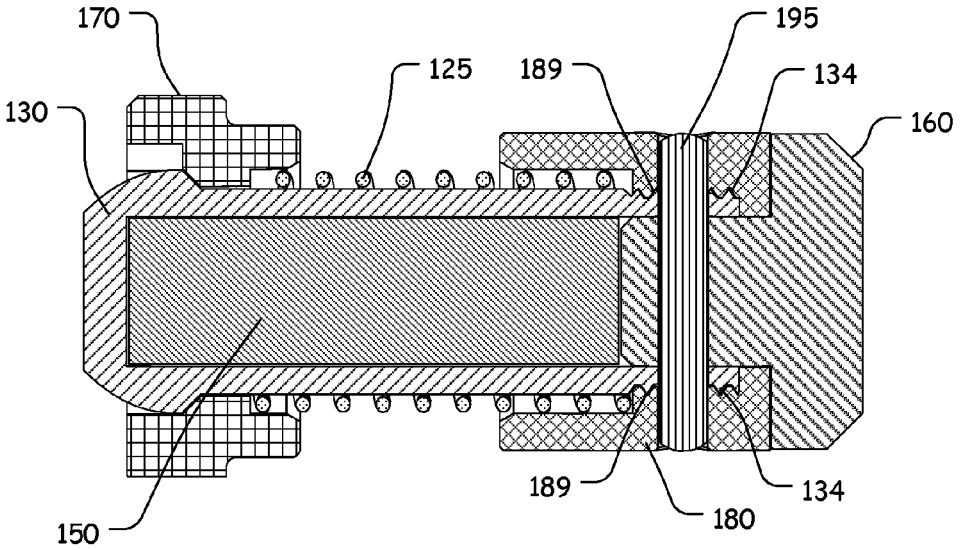
FIG. 52 illustrates an left side, cross-sectional view of an exemplary embodiment of an assembled, recoil buffer system, according to the presently disclosed systems, methods, and/or apparatuses, wherein the components are in an uncompressed position.

FIGS. 49-51 illustrate various components and/or elements of an exemplary embodiment of a buffer element, according to the presently disclosed systems, methods, and/or apparatuses. As illustrated in FIG. 49, the optional first buffer element chamfer 133 is more radiused, rounded, or arcuate so as to provide a radiused or substantially radiused transitional surface between the buffer element knob 137 and the first end 131 of the buffer element 130.

It should be appreciated that the more rounded or arcuate first buffer element chamfer 133 may be formed at any desired radius, arc, or angle, so as to provide a transition surface between the buffer element knob 137 and the first end 131 of the buffer element 130.

In certain exemplary embodiments, the more rounded or arcuate first buffer element chamfer 133 may be formed so as to provide a transition surface between the second buffer element chamfer 136 and the first end 131 of the buffer element 130.

As further illustrated in FIGS. 49-51, an externally threaded portion 134 is formed in a portion of the buffer element body portion 135, extending from the second end 132 of the buffer element 130. An internally threaded portion 189 is formed in a portion of the sleeve spring recess 185 of the sleeve 180.

In these exemplary embodiments, the interaction of the externally threaded portion 134 and the internally threaded portion 189 allows the buffer element body portion 135 to be threadedly attached or connected to the sleeve 180.

While the buffer element 130 has been illustrated as being attached, coupled, or connected to the sleeve 180 by a retaining pin 195 or interaction of the externally threaded portion 134 and the internally threaded portion 189, it should be appreciated that the buffer element 130 may be pinned, threadedly attached or coupled, attached or coupled through interaction of one or more lugs and corresponding recesses, attached or coupled by an adhesive, welded, and/or bonded to the sleeve 180. Thus, it should be understood that the buffer element 130 may be attached, coupled, or connected to the sleeve 180 in any desired manner.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A recoil buffer system, comprising:

a buffer tube, wherein said buffer tube extends, along a longitudinal axis, from a first end to a second end and having an internal buffer tube cavity defined by an open end, one or more side walls, and a bottom wall;

a buffer tube recoil spring;

a buffer element, wherein said buffer element comprises an elongate buffer element body portion extending from a buffer element knob, wherein said buffer element comprises a buffer element cavity defined by an open end, one or more side walls, and a bottom wall, and wherein an externally threaded portion is formed in a portion of said buffer element body portion;

a collar, wherein a collar aperture is formed through said collar, along a longitudinal axis of said collar, wherein a collar recess extends from a first end of said collar and is defined by one or more side walls and a collar recess shoulder;

a sleeve, wherein a sleeve aperture is formed through said sleeve, along a longitudinal axis of said sleeve, wherein said sleeve aperture is formed so as to accept at least a portion of said bumper therein, wherein a sleeve recess extends from a first end of said sleeve and is defined by one or more side walls and a sleeve spring recess shoulder, wherein said sleeve recess is formed so as to accept at least a portion of said buffer element body portion therein, and wherein an internally threaded portion is formed in a portion of a sidewall of said sleeve aperture of said sleeve, and wherein interaction of said externally threaded portion of said buffer element body portion and said internally threaded portion of said sleeve allows said buffer element body portion to be threadedly attached or connected to said sleeve;

a buffer element recoil spring, wherein said buffer element recoil spring is positioned about at least a portion of said elongate buffer element body portion, between said collar and said sleeve; and a bumper, wherein a bumper extension portion extends from a first end of said bumper to a bumper shoulder, wherein said bumper extension portion is such that at least a portion of said bumper extension portion can be fitted at least partially within said sleeve aperture.

2. The recoil buffer system of claim 1, wherein said collar recess is formed so as to accept at least a portion of said buffer element knob at least partially therein.

3. The recoil buffer system of claim 1, wherein said collar aperture has a diameter that is less than a diameter of said collar recess and allows said buffer element body portion to be slidable within said collar aperture.

4. The recoil buffer system of claim 1, wherein said buffer element recoil spring has a spring rate or spring biasing force that is less than, equal to, or greater than a spring rate or spring biasing force of said buffer tube recoil spring.

5. The recoil buffer system of claim 1, wherein said sleeve comprises a buffer element retaining pin aperture that extends at least partially through said sleeve and is formed so as to accept at least a portion of a retaining pin therethrough.

6. The recoil buffer system of claim 1, further comprising:

a weight, wherein said weight is positioned within said buffer element cavity and wherein said weight comprises a solid portion of material, a powdered or granulated material, or a liquid.

7. The recoil buffer system of claim 1, wherein when said buffer element is in a compressed position, at least a portion of said buffer element knob extends at least partially into an inside diameter of a bolt carrier.

8. The recoil buffer system of claim 1, wherein when said buffer element is in a compressed position, at least a portion of said buffer element knob extends from said collar.

9. The recoil buffer system of claim 1, further comprising:

a bumper retaining aperture that extends at least partially through said bumper extension portion and is formed so as to accept at least a portion of a retaining pin therethrough.

10. The recoil buffer system of claim 1, wherein said buffer element recoil spring has an external diameter that is less than an internal diameter of said buffer tube recoil spring.

11. The recoil buffer system of claim 1, wherein a chamfer is formed as a transition between said first end of said buffer element body portion and said buffer element knob.

12. The recoil buffer system of claim 1, wherein said externally threaded portion of said buffer element body portion is formed proximate said open end.

13. The recoil buffer system of claim 1, further comprising:

a sleeve retaining pin aperture that extends at least from an outer surface of said sleeve body into said sleeve aperture.

14. A recoil buffer system, comprising:

a buffer element, wherein said buffer element extends from a buffer element knob, wherein said buffer element comprises a buffer element cavity defined by an open end, one or more side walls, and a bottom wall, and wherein an externally threaded portion is formed in a portion of said buffer element body portion;

a collar, wherein a collar aperture is formed through said collar, along a longitudinal axis of said collar, wherein a collar recess extends from a first end of said collar and is defined by one or more side walls and a collar recess shoulder;

a sleeve, wherein a sleeve aperture is formed through said sleeve, along a longitudinal axis of said sleeve, wherein said sleeve aperture is formed so as to accept at least a portion of said bumper therein, wherein a sleeve recess extends from a first end of said sleeve and is defined by one or more side walls and a sleeve spring recess shoulder, wherein said sleeve recess is formed so as to accept at least a portion of said buffer element body portion therein, and wherein an internally threaded portion is formed in a portion of a sidewall of said sleeve aperture of said sleeve, and wherein interaction of said externally threaded portion of said buffer element body portion and said internally threaded portion of said sleeve allows said buffer element body portion to be threadedly attached or connected to said sleeve;

a buffer element recoil spring, wherein said buffer element recoil spring is positioned about at least a portion of said elongate buffer element body portion, between said collar and said sleeve; and a bumper, wherein a bumper extension portion extends from a first end of said bumper to a bumper shoulder, wherein said bumper extension portion is such that at least a portion of said bumper extension portion can be fitted at least partially within said sleeve aperture.

15. The recoil buffer system of claim 14, wherein said collar recess is formed so as to accept at least a portion of said buffer element knob at least partially therein.

16. The recoil buffer system of claim 14, wherein said collar aperture has a diameter that is less than a diameter of said collar recess and allows said buffer element body portion to be slidable within said collar aperture.

17. The recoil buffer system of claim 14, further comprising:

a weight, wherein said weight is positioned within said buffer element cavity and wherein said weight comprises a solid portion of material, a powdered or granulated material, or a liquid.

18. The recoil buffer system of claim 14, wherein when said buffer element is in a compressed position, at least a portion of said buffer element knob extends at least partially into an inside diameter of a bolt carrier.

19. The recoil buffer system of claim 14, wherein when said buffer element is in a compressed position, at least a portion of said buffer element knob extends from said collar.

20. A recoil buffer system, comprising:

a buffer element, wherein said buffer element extends from a buffer element knob, wherein said buffer element comprises a buffer element cavity defined by an open end, one or more side walls, and a bottom wall, and wherein an externally threaded portion is formed in a portion of said buffer element body portion;

a collar, wherein a collar aperture is formed through said collar, along a longitudinal axis of said collar, wherein a collar recess extends from a first end of said collar and is defined by one or more side walls and a collar recess shoulder;

a sleeve, wherein a sleeve aperture is formed through said sleeve, along a longitudinal axis of said sleeve, wherein a sleeve recess extends from a first end of said sleeve and is defined by one or more side walls and a sleeve spring recess shoulder, wherein said sleeve recess is formed so as to accept at least a portion of said buffer element body portion therein, and wherein an internally threaded portion is formed in a portion of a sidewall of said sleeve aperture of said sleeve, and wherein interaction of said externally threaded portion of said buffer element body portion and said internally threaded portion of said sleeve allows said buffer element body portion to be threadedly attached or connected to said sleeve; and a buffer element recoil spring, wherein said buffer element recoil spring is positioned about at least a portion of said elongate buffer element body portion, between said collar and said sleeve.

* * * * *